US012520925B2

(12) United States Patent
Jablonski et al.

(10) Patent No.: US 12,520,925 B2
(45) Date of Patent: Jan. 13, 2026

(54) COMBINATION OF LIQUID COLORANT TECHNOLOGY AND DEVELOPER HOUSED IN A CARTRIDGE AND PAIRED WITH THE COLORSONIC DEVICE WITH OPTIMIZED NUMBER OF STATIC MIXERS AND FLOW-PATH DESIGN, THAT DISPENSES COLORANT MIXTURE WITH AN IDEAL, NON-DRIPPING ASPECT

(71) Applicant: L'OREAL, Paris (FR)

(72) Inventors: Lisa Jablonski, Helmetta, NJ (US); Ji Lee, New York, NY (US); Damien Levi, Berkeley Heights, NJ (US); Marie-Yves Hampton, Maplewood, NJ (US); Yamini Patel, East Brunswick, NJ (US); Anne Wagner, Media, PA (US); Curtis Yang, Edison, NJ (US)

(73) Assignee: L'Oreal, Paris (FR)

( * ) Notice: Subject to any disclaimer, the term of this patent is extended or adjusted under 35 U.S.C. 154(b) by 661 days.

(21) Appl. No.: 18/060,258

(22) Filed: Nov. 30, 2022

(65) Prior Publication Data

US 2024/0172858 A1 May 30, 2024

(51) Int. Cl.

| | |
|---|---|
| ***A45D 34/00*** | (2006.01) |
| ***A45D 19/00*** | (2006.01) |
| ***A45D 34/04*** | (2006.01) |

(52) U.S. Cl.

CPC ..... *A45D 34/04* (2013.01); *A45D 19/00* (2013.01); *A45D 19/0066* (2021.01);

(Continued)

(58) Field of Classification Search

CPC .... A45D 34/04; A45D 19/00; A45D 19/0066; A45D 2034/005; A45D 2200/056; A45D 2200/058

(Continued)

(56) References Cited

U.S. PATENT DOCUMENTS

| | | | |
|---|---|---|---|
| 6,357,450 | B1 | 3/2002 | Paice |
| 10,598,230 | B2 | 3/2020 | Grez et al. |

(Continued)

FOREIGN PATENT DOCUMENTS

| | | | |
|---|---|---|---|
| WO | 2015034105 | A2 | 3/2015 |
| WO | 2019161360 | A1 | 8/2019 |
| WO | 2022182670 | A1 | 9/2022 |

OTHER PUBLICATIONS

Search Report and Written Opinion dated Aug. 29, 2023, issued in corresponding French Application No. 2301306, filed Feb. 13, 2023, 7 pages.

*Primary Examiner* — Eisa B Elhilo

(74) *Attorney, Agent, or Firm* — CHRISTENSEN O'CONNOR JOHNSON KINDNESS PLLC

(57) ABSTRACT

Formulation delivery systems, formulation delivery devices, and formulation cartridges for the same are provided. Formulation delivery systems include a reusable handle, a formulation dispensing assembly, and a controller. The formulation dispensing assembly includes a reciprocating nozzle assembly and a pump. The reciprocating nozzle assembly is fluidically-coupleable to the formulation cartridge or the cleaning cartridge received within the reusable handle. Formulation delivery devices include a reusable handle configured to receive a formulation cartridge therein, and a formulation dispensing assembly disposed in the reusable handle. The formulation dispensing assembly includes fluid conduits, a pump fluidically connected to the fluid conduits, a reciprocating nozzle assembly, and a controller. Formulation cartridges include a reusable cartridge body and a formulation cartridge refill unit.

20 Claims, 13 Drawing Sheets

(52) U.S. Cl.
CPC .. *A45D 2034/005* (2013.01); *A45D 2200/056* (2013.01); *A45D 2200/058* (2013.01)

(58) Field of Classification Search
USPC ..... 222/135
See application file for complete search history.

(56) References Cited

U.S. PATENT DOCUMENTS

| | | | | |
|---|---|---|---|---|
| 10,694,832 | B2 | 6/2020 | Grez | |
| 10,918,183 | B2 | 2/2021 | Dreher et al. | |
| 11,534,263 | B2 * | 12/2022 | Lee | A46B 13/02 |
| 2017/0251783 | A1 | 9/2017 | Grez | |
| 2018/0116363 | A1 | 5/2018 | Grez | |
| 2019/0098974 | A1 | 4/2019 | Grez et al. | |
| 2019/0098975 | A1 | 4/2019 | Grez et al. | |
| 2019/0098976 | A1 | 4/2019 | Grez et al. | |
| 2019/0191844 | A1 | 6/2019 | Dreher et al. | |
| 2020/0354134 | A1 | 11/2020 | Sherrell et al. | |
| 2022/0273084 | A1 * | 9/2022 | Lee | A45D 19/005 |
| 2022/0273086 | A1 * | 9/2022 | Lee | A45D 34/042 |
| 2022/0273400 | A1 * | 9/2022 | Lee | B05B 3/14 |

* cited by examiner

COMBINATION OF LIQUID COLORANT TECHNOLOGY AND DEVELOPER HOUSED IN A CARTRIDGE AND PAIRED WITH THE COLORSONIC DEVICE WITH OPTIMIZED NUMBER OF STATIC MIXERS AND FLOW-PATH DESIGN, THAT DISPENSES COLORANT MIXTURE WITH AN IDEAL, NON-DRIPPING ASPECT

BACKGROUND

Prior to applying a hair colorant formulation, a liquid dye and an alkaline developer component are first mixed together. Different formulation colors naturally have different dye loads. As a result, different mixed formulations exhibit different rheological characteristics and properties, e.g., viscosity and shear rate. Although such varying rheological performance between formulations can be readily compensated for when manually mixing and applying formulations to hair by brush, variation between formulations complicates the delivery of formulations from a common formulation delivery device. For example, certain formulations having relatively low viscosity may drip from the device, whereas formulations having relatively high viscosity may dispense in beads onto a user's head. Consequently, there is a need for formulation delivery devices and methods that dispense a wide range of formulations, regardless of dye load, without dripping but with enough viscosity that is appropriate for application/adherence to the hair.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In an aspect, the present disclosure is directed to, among other things, systems, devices, and cartridges for delivering a formulation, and methods for using the same. In an embodiment, described are one or more methodologies or technologies that are configured to deliver a cosmetic formulation having a dye component and a developer component to a user's skin, hair, and the like. Advantageously, the disclosed embodiments provide better user experience, better performance and reliability, and more sustainable construction.

In another aspect, a formulation delivery system, including a first formulation source storing a first liquid formulation, wherein the first liquid formulation including (a) a surfactant system, (b) at least one alkaline component, (c) at least one chelating agent, (d) optionally, at least one natural oil, and (e) a solvent system. The formulation delivery system may also include a second formulation source storing a second liquid formulation, wherein the second liquid formulation comprises hydrogen peroxide, a formulation dispensing assembly configured to fluidically couple with the first formulation source and the second formulation source, the formulation dispensing assembly including a first fluid conduit and a second fluid conduit respectively connected with the first formulation source and the second formulation source, a pump fluidically connected to the first fluid conduit and second fluid conduit, a mixing chamber connected with the first fluid conduit and the second fluid conduit, wherein the mixing chamber mixes the first formulation with the second formulation into a mixed formulation having a 1:1 mixture ratio of the first formulation and the second formulation with a 20% mixture ratio tolerance, and a nozzle assembly in fluid connection with the mixing chamber is disclosed.

In another aspect, a method of preparing a mixed formulation, the method comprising drawing a liquid colorant and a liquid developer from a formulation cartridge into a formulation dispensing assembly, wherein the liquid colorant includes (a) a surfactant system, (b) at least one alkaline component, (c) at least one chelating agent, (d) optionally, at least one natural oil, and (e) a solvent system, mixing the liquid colorant and the liquid developer in a mixing chamber of the formulation dispensing assembly, wherein the mixing chamber mixes the first formulation with the second formulation into a mixed formulation having a 1:1 mixture ratio of the first formulation to the second formulation with a 20% mixture ratio tolerance, and dispensing the mixed formulation from the formulation dispensing assembly, wherein the mixed formulation has a mixed formulation viscosity of at least 2.0 Pa-s at an outlet nozzle assembly of the formulation dispensing assembly is disclosed.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
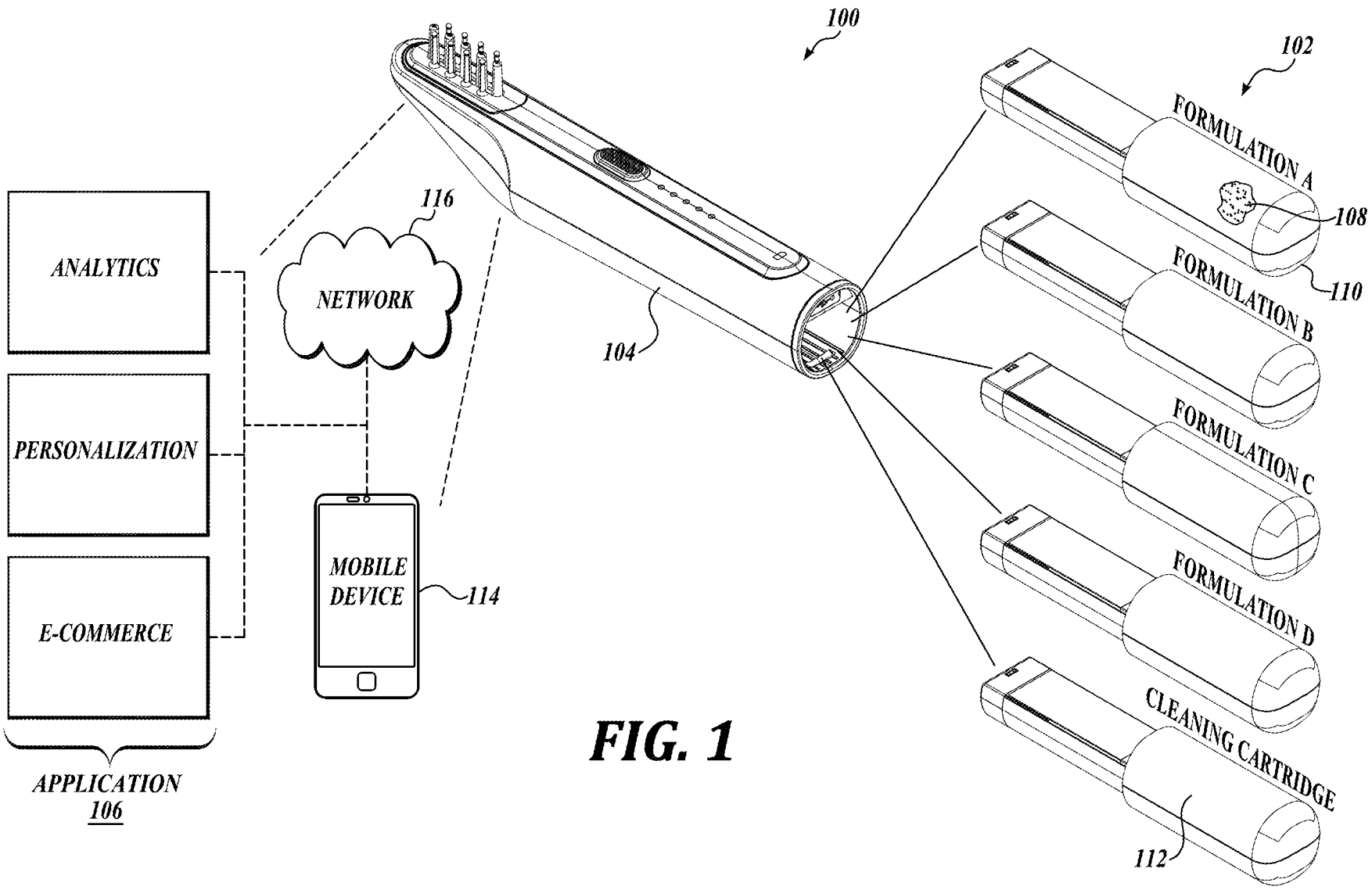
FIG. 1 shows a schematic view of a formulation delivery system, in accordance with a representative embodiment of the present disclosure.

Described are one or more methodologies or technologies for allowing users to apply treatment formulations to human hair and scalp tissue. The following description provides representative examples that relate generally to hair and scalp treatment delivery systems, devices, and formulation cartridges for the same. In an embodiment, it is beneficial for the treatment formulation to be applied to a targeted portion of the hair or scalp tissue. In an embodiment, applying a treatment formulation to a portion of the hair near the scalp is desired, for instance, when applying a coloring dye to roots of hair during a color maintenance procedure. In another example, an approach requires applying a scalp treatment formulation directly to the scalp tissue, while minimizing contact with the hair.

Existing systems for the application of hair and scalp treatment formulations have been widely used. In one example, hair-coloring kits are generally used to change the appearance of the hair color or to blend gray hairs, among other uses. Existing hair coloring systems have several disadvantages, including difficulty of use, time consumption, uneven coverage, unpredictable results, excessive mess, etc. In one aspect, existing hair coloring systems can be ineffective in blending and coloring the roots of the hair after new segments of hair have grown from the scalp, where the natural hair color differs from the remainder of the dyed hair. The present disclosure is directed toward solving these and other needs.

In some embodiments, hair coloring formulation includes at least one dye and a separate developer, which are mixed in controlled proportions. However, "formulation" is not limited to dye and developer in this disclosure. As used herein, the term "formulation" refers generally to any of the dye, developer, formulation, fluid, or any mixture thereof. In this disclosure, "formulation" includes: permanent hair dye; semi-permanent hair dye; developer; conditioner; hair growth treatment, such as minoxidil manufactured under the trade name ROGAINE®; hair protein treatment; disulfide bond repairing hair treatment; fluid hair treatment; fluid scalp treatment, and the like.

Embodiments of the present disclosure are configured to apply formulation to targeted areas of the hair and scalp tissue. Although any of the above-mentioned formulations are suitably applied using the embodiments described herein, the present disclosure generally refers to hair coloring formulation as one o example of treatment formulation applied by the systems and devices described below. However, it shall be appreciated that any of the systems, devices, cartridges, and methods may be utilized with any of the above-mentioned formulations.

In one aspect, a formulation delivery system, including a first formulation source storing a first liquid formulation, wherein the first liquid formulation comprises comprising (a) a surfactant system comprising (i) at least one fatty amide, (ii) at least one alkoxylated fatty alcohol, (iii) at least one fatty alcohol other than the alkoxylated fatty alcohol, and, and (iv) at least one anionic surfactant, (b) at least one alkaline component, (c) at least one chelating agent, (d) optionally, at least one natural oil, and (e) a solvent system comprising (i) at least one glycol, (ii) at least one monoalcohol, and (iii) water is discloses. The first liquid formulation may optionally comprise additional components, for example at least one thickening agent. Optionally, the first liquid formulation may be free or substantially free of mineral oil, ammonia, ammonium hydroxide, and/or ammonium thiolactate.

In yet further embodiments, the disclosure relates to first liquid formulation comprising (a) from about 10% to about 40% of a surfactant system comprising (i) at least one fatty amide, (ii) at least one alkoxylated fatty alcohol, (iii) at least one fatty alcohol other than the alkoxylated fatty alcohol, and, and (iv) at least one anionic surfactant, (b) at least 5% of at least one organic alkalizing agent, (c) at least one chelating agent, (d) optionally, at least about 0.1% of at least one natural oil, and (e) a solvent system comprising (i) from about 3% to about 25% of at least one glycol, (ii) from about 3% to about 20% of at least one monoalcohol, and (iii) water, wherein all amounts are by weight, relative to the total weight of the first liquid formulation. In various embodiments, the (b) at least one organic alkalizing agent may be chosen from monoethanolamine, diethanolamine, triethanolamine, monoisopropanolamine, diisopropanolamine, triisopropanolamine, N,N-dimethylethanolamine, 2-amino-2-methyl-1-propanol, 2-amino-2-methyl-1,3-propanediol, 3-amino-1,2-propanediol, 3-dimethylamino-1,2-propanediol, tris(hydroxymethyl)amino-methane, or mixtures thereof. In various embodiments, the (c) at least one chelating agent may be chosen from chelating agents based on aminocarboxylic acids, iminodisuccinic acid, ethanoldiglycine acid, phosphonobutane tricarboxylic acid, tetrasodium glutamate diacetate, monophosphonic acid, polyphosphonic acid, polyphosphoric acid, or mixtures thereof. In various embodiments, the (e)(ii) at least one monoalcohol may be chosen from C1-C18 monoalcohols, preferably C1-C16 monoalcohols, more preferably chosen from C2-C12 monoalcohols, most preferably C2-C8 monoalcohols. The first liquid formulation may optionally comprise additional components, for example at least one thickening agent. Optionally, the first liquid formulation may be free or substantially free of mineral oil, ammonia, ammonium hydroxide, and/or ammonium thiolactate.

In still further embodiments, the disclosure relates to a first liquid formulation including (a) from about 10% to about 40%, such as from about 12% to about 35%, preferably from about 15% to about 30%, more preferably from about 17% to about 25%, most preferably from about 18% to about 22%, of a surfactant system comprising (i) from about 2% to about 15%, preferably from about 4% to about 12%, more preferably from about 6% to about 10% of at least one fatty amide, (ii) from about 3% to about 15%, preferably from about 4% to about 12%, more preferably from about 5% to about 10%, most preferably from about 6% to about 8% of at least one alkoxylated fatty alcohol, (iii) from about 0.1% to about 5%, preferably from about 0.25% to about 4%, more preferably from about 0.5% to about 3%, most preferably from about 0.75% to about 2.5% of at least one fatty alcohol other than the alkoxylated fatty alcohol, and, and (iv) at least one anionic surfactant, (b) from about 5% to about 20%, preferably from about 6% to about 18%, more preferably from about 7% to about 15%, most preferably from about 8% to about 12% of at least one organic alkalizing agent, (c) from about 0.01% to about 2%, preferably from about 0.05% to about 1%, more preferably from about 0.1% to about 0.8%, most preferably from about 0.2% to about 0.5% of at least one chelating agent, (d) from about 0.1% to about 10%, preferably from about 0.2% to about 8%, more preferably from about 0.3% to about 6% of at least one natural oil, and (e) a solvent system comprising (i) from about 3% to about 25%, such as from about 3% to about 22%, preferably from about 4% to about 20%, more preferably from about 5% to about 18%, most preferably from about 6% to about 15% of at least one glycol, (ii) from about 3% to about 20%, such as from about 4% to about 18%, preferably from about 5% to about 15%, more preferably from about 6% to about 12%, most preferably from about 7% to about 10% of at least one monoalcohol, and (iii) water, wherein all amounts are by weight, relative to the total weight of the first liquid formulation. In various embodiments, the (b) at least one organic alkalizing agent may be chosen from monoethanolamine, diethanolamine, triethanolamine, monoisopropanolamine, diisopropanolamine, triisopropanolamine, N,N-dimethylethanolamine, 2-amino-2-methyl-1-propanol, 2-amino-2-methyl-1,3-propanediol, 3-amino-1,2-propanediol, 3-dimethylamino-1,2-propanediol, tris(hydroxymethyl)amino-methane, or mixtures thereof. In various embodiments, the (c) at least one chelating agent may be chosen from chelating agents based on aminocarboxylic acids, iminodisuccinic acid, ethanoldiglycine acid, phosphonobutane tricarboxylic acid, tetrasodium glutamate diacetate, monophosphonic acid, polyphosphonic acid, polyphosphoric acid, or mixtures thereof. In various embodiments, the (e)(ii) at least one monoalcohol may be chosen from C1-C18 monoalcohols, preferably C1-C16 monoalcohols, more preferably chosen from C2-C12 monoalcohols, most preferably C2-C8 monoalcohols. The first liquid formulation may optionally comprise additional components, for example at least one thickening agent, for example in an amount ranging from about 0.1% to about 10%, preferably from about 0.2% to about 8%, more preferably from about 0.3% to about 6%, most preferably from about 0.5% to about 4%. Optionally, the first liquid formulation may be free or substantially free of mineral oil, ammonia, ammonium hydroxide, and/or ammonium thiolactate.

In yet further embodiments, the disclosure relates to a first liquid formulation comprising (a) from about 10% to about 40% of a surfactant system comprising (i) at least one fatty amide, (ii) at least one alkoxylated fatty alcohol, (iii) at least one fatty alcohol other than the alkoxylated fatty alcohol, and, and (iv) at least one anionic surfactant, (b) an alkaline component comprising (i) at least 0.5% of at least one organic alkalizing agent, and (ii) at least one mineral alkalizing agent, present in an amount up to about 15%, (c) at least one chelating agent, (d) optionally, at least about 0.1% of at least one natural oil, and (e) a solvent system comprising (i) from about 5% to about 30% of at least one glycol, (ii) from about 3% to about 20% of at least one monoalcohol, and (iii) water, wherein all amounts are by weight, relative to the total weight of the first liquid formulation. In various embodiments, the (b) at least one organic alkalizing agent may be chosen from monoethanolamine, diethanolamine, triethanolamine, monoisopropanolamine, diisopropanolamine, triisopropanolamine, N,N-dimethylethanolamine, 2-amino-2-methyl-1-propanol, 2-amino-2-methyl-1,3-propanediol, 3-amino-1,2-propanediol, 3-dimethylamino-1,2-propanediol, tris(hydroxymethyl)amino-methane, or mixtures thereof. In various embodiments, the (c) at least one chelating agent may be chosen from chelating agents based on aminocarboxylic acids, iminodisuccinic acid, ethanoldiglycine acid, phosphonobutane tricarboxylic acid, tetrasodium glutamate diacetate, monophosphonic acid, polyphosphonic acid, polyphosphoric acid, or mixtures thereof. In various embodiments, the (e)(ii) at least one monoalcohol may be chosen from C1-C18 monoalcohols, preferably C1-C16 monoalcohols, more preferably chosen from C2-C12 monoalcohols, most preferably C2-C8 monoalcohols. The first liquid formulation may optionally comprise additional components, for example at least one thickening agent. Optionally, the first liquid formulation may be free or substantially free of mineral oil, ammonia, ammonium hydroxide, and/or ammonium thiolactate.

In still further embodiments, the disclosure relates to a first liquid formulation comprising (a) from about 10% to about 40%, such as from about 12% to about 40%, preferably from about 15% to about 35%, more preferably from about 17% to about 33%, most preferably from about 18% to about 30%, of a surfactant system comprising (i) from about 5% to about 25%, preferably from about 6% to about 20%, more preferably from about 8% to about 18%, most preferably from about 10% to about 16% of at least one fatty amide, (ii) from about 3% to about 20%, preferably from about 4% to about 18%, more preferably from about 5% to about 15%, most preferably from about 6% to about 12% of at least one alkoxylated fatty alcohol, (iii) from about 0.1% to about 6%, preferably from about 0.25% to about 5%, more preferably from about 0.5% to about 4%, most preferably from about 0.75% to about 3.5% of at least one fatty alcohol other than the alkoxylated fatty alcohol, and, and (iv) from about 0.5% to about 15%, preferably from about 1% to about 10%, more preferably from about 2% to about 8%, most preferably from about 3% to about 6% of at least one anionic surfactant, (b) an alkaline component comprising (i) at least 0.5%, such as from about 0.5% to about 10%, preferably from about 1% to about 8%, more preferably from about 2% to about 7%, most preferably from about 3% to about 6% of at least one organic alkalizing agent, and (ii) at least one mineral alkalizing agent, present in an amount up to about 15%, such as from about 0.01% to about 10%, preferably from about 0.1% to about 8%, more preferably from about 0.2% to about 6%, most preferably from about 0.3% to about 4%, (c) from about 0.01% to about 2%, preferably from about 0.05% to about 1%, more preferably from about 0.1% to about 0.8%, most preferably from about 0.2% to about 0.5% of at least one chelating agent, (d) from about 0.1% to about 10%, preferably from about 0.2% to about 8%, more preferably from about 0.3% to about 6% of at least one natural oil, and (e) a solvent system comprising (i) from about 6% to about 28%, such as from about 7% to about 25%, preferably from about 8% to about 20%, more preferably from about 9% to about 18% of at least one glycol, (ii) from about 4% to about 18%, preferably from about 5% to about 15%, more preferably from about 6% to about 12%, most preferably from about 7% to about 11% of at least one monoalcohol, and (iii) water, wherein all amounts are by weight, relative to the total weight of the first liquid formulation. In various embodiments, the (b) at least one organic alkalizing agent may be chosen from monoethanolamine, diethanolamine, triethanolamine, monoisopropanolamine, diisopropanolamine, triisopropanolamine, N,N-dimethylethanolamine, 2-amino-2-methyl-1-propanol, 2-amino-2-methyl-1,3-propanediol, 3-amino-1,2-propanediol, 3-dimethylamino-1,2-propanediol, tris(hydroxymethyl)amino-methane, or mixtures thereof. In various embodiments, the (c) at least one chelating agent may be chosen from chelating agents based on aminocarboxylic acids, iminodisuccinic acid, ethanoldiglycine acid, phosphonobutane tricarboxylic acid, tetrasodium glutamate diacetate, monophosphonic acid, polyphosphonic acid, polyphosphoric acid, or mixtures thereof. In various embodiments, the (e)(ii) at least one monoalcohol may be chosen from C1-C18 monoalcohols, preferably C1-C16 monoalcohols, more preferably chosen from C2-C12 monoalcohols, most preferably C2-C8 monoalcohols. The first liquid formulation may optionally comprise additional components, for example at least one thickening agent, for example in an amount ranging from about 0.1% to about 10%, preferably from about 0.2% to about 8%, more preferably from about 0.3% to about 6%, most preferably from about 0.5% to about 4%. Optionally, the first liquid formulation may be free or substantially free of mineral oil, ammonia, ammonium hydroxide, and/or ammonium thiolactate.

In one embodiment, the first liquid formulation comprises (a) from about 15% to about 30% of a surfactant system comprising (i) at least one fatty amide, (ii) at least one alkoxylated fatty alcohol, (iii) at least one fatty alcohol other than the alkoxylated fatty alcohol, present in an amount up to about 3%, and (iv) at least one anionic surfactant; (b) an alkaline component comprising (i) at least about 0.5% of monoethanolamine, and (ii) at least one mineral alkalizing agent, present in an amount up to about 15%; (c) tetrasodium glutamate diacetate; (d) optionally, at least about 0.5% of at least one natural oil; and (e) a solvent system comprising (i) from about 10% to about 20% of at least one glycol, (ii) from about 5% to about 15% of at least one monoalcohol chosen from C2-C12 monoalcohols, and (iii) water, wherein all amounts are by weight, relative to the total weight of the first liquid formulation. In a further embodiment, the first liquid formulation comprises (a) from about 20% to about 30% of a surfactant system comprising (i) from about 8% to about 16% of at least one fatty amide, (ii) from about 5% to about 15% of at least one alkoxylated fatty alcohol, (iii) from about 0.5% to about 5% of at least one fatty alcohol other than the alkoxylated fatty alcohol, and (iv) from about 2% to about 8% of at least one anionic surfactant; (b) an alkaline component comprising (i) from about 2% to about 8% of monoethanolamine, and (ii) from about 0.5% to about 5% of at least one mineral alkalizing agent; (c) tetrasodium glutamate diacetate; (d) from about 0.5% to about 2% of at least one natural oil; and (e) a solvent system comprising (i) from about 5% to about 15% of at least one glycol, (ii) from about 5% to about 15% of at least one monoalcohol chosen from C2-C8 monoalcohols, and (iii) water, wherein the first liquid formulation is free of mineral oil, ammonia, and/or ammonia hydroxide; and wherein all amounts are by weight, relative to the total weight of the first liquid formulation.

In some embodiments, the device further includes a second formulation source storing a second liquid formulation, wherein the second liquid formulation comprising hydrogen peroxide. In some embodiments, the second liquid formulation may be, for example, chosen from peroxides, persulfates, perborates, percarbonates, alkali metal bromates, ferricyanides, peroxygenated salts, or a mixture thereof. Second liquid formulation s that may also be used include at least one redox enzyme such as laccases, peroxidases, and 2-electron oxidoreductases, such as uricase, where appropriate in the presence of their respective donor or co-factor. Oxygen in the air may also be an oxidizing component.

In certain embodiments, the second liquid formulation is hydrogen peroxide. In various embodiments, the hydrogen peroxide may be present in an aqueous solution whose titer may range from 1 to 40 volumes, such as from 5 to 40 volumes, from 5 to 30 volumes, or from 5 to 20 volumes. In certain embodiments, the oxidizing component is a 20V, 30V, or 40V hydrogen peroxide developer composition.

In other embodiments, the second liquid formulation is a persulfate and/or a monopersulfate such as, for example, potassium persulfate, sodium persulfate, ammonium persulfate, as well as mixtures thereof. In some embodiments, the second liquid formulations are chosen from hydrogen peroxide, potassium persulfate, sodium persulfate, or mixtures thereof.

The second liquid formulation may, in various embodiments, be present in the developer composition in an amount ranging from about 0.05% to about 50% by weight, such as from about 0.1% to about 30% by weight, from about 0.1% to about 20% by weight, about 1% to about 20%, about 1% to about 15%, about 1% to about 12%, about 3% to about 20%, about 3% to about 15%, about 3% to about 12%, about 5% to about 20%, about 5% to about 15%, about 5% to about 12%, about 7% to about 20%, about 7% to about 15%, about 7% to about 12%, about 9% to about 20%, about 9% to about 15%, or about 9% to about 12% by weight, based on the total weight of the developer composition.

The developer composition may contain at least one solvent, for example water, organic solvents, or mixtures thereof. Suitable organic solvents for use in the developer composition, alone or in mixture with water, include but are not limited to ethanol, isopropyl alcohol, propanol, benzyl alcohol, phenyl ethyl alcohol, glycols and glycol ethers, such as propylene glycol, hexylene glycol, ethylene glycol monomethyl, monoethyl or monobutyl ether, propylene glycol and its ethers, such as propylene glycol monomethyl ether, butylene glycol, dipropylene glycol, diethylene glycol alkyl ethers, such as diethylene glycol monoethyl ether and monobutyl ether, ethylene glycol, propylene glycol, butylene glycol, hexylene glycol, propane diol, glycerin, hydrocarbons such as straight chain hydrocarbons, mineral oil, polybutene, hydrogenated polyisobutene, hydrogenated polydecene, polydecene, squalane, petrolatum, isoparaffins, or mixtures thereof.

The organic solvents for use according to the developer compositions can be volatile or non-volatile compounds. The organic solvent may, for example, be present in an amount ranging from about 0.5% to about 70% by weight, such as from about 2% to about 60% by weight, such as from about 5 to about 50% by weight, relative to the total weight of the developer composition.

The developer compositions may optionally include other components typically used in developer compositions, such as, for example, rheology-modifying agents, chelants, fatty substances, ceramides, pH adjusting agents, preservatives, fragrances, surfactants, etc.

The developer composition may be in the form of a powder, gel, liquid, foam, lotion, cream, mousse, or emulsion. In certain embodiments the developer composition is aqueous and is in the form of a liquid, cream, or emulsion. In other embodiments, the developer composition is anhydrous or substantially anhydrous.

In some non-limiting embodiments where the developer composition is liquid, e.g. aqueous, the developer composition may have a viscosity ranging from about 250 to about 2000 cps, such as, for example, from about 500 to about 2500 cps, about 500 to about 2000 cps, about 500 to about 1500 cps, about 600 to about 1300 cps, or about 650 to about 1200 cps when measured at 25° C. using a #4 spindle at 100 rpm.

In some embodiments, the device further includes a formulation dispensing assembly configured to fluidically couple with the first formulation source and the second formulation source, the formulation dispensing assembly including a first fluid conduit and a second fluid conduit respectively connected with the first formulation source and the second formulation source, a pump fluidically connected to the first fluid conduit and second fluid conduit, a mixing chamber connected with the first fluid conduit and the second fluid conduit, wherein the mixing chamber mixes the first formulation with the second formulation into a mixed formulation having a 1:1 mixture ratio of the first formulation and the second formulation with a 20% mixture ratio tolerance; and a nozzle assembly in fluid connection with the mixing chamber is disclosed.

In some embodiments, the first liquid formulation has a dye load from 0.05% to 5.5%. In some embodiments, the mixed formulation has a mixed formulation viscosity of at least 2.0 Pa-s. In some embodiments, the mixed formulation viscosity is from 2.0 Pa-s to 4.0 Pa-s.

In some embodiments, the first liquid formulation is ammonia-free. In some embodiments, the first liquid formulation comprises ammonia and monoethanolamine. In some embodiments, the first liquid formulation comprises resorcinol. In some embodiments, the first liquid formulation is free of resorcinol and resorcinol derivatives.

In some embodiments, the mixture ratio is defined as a mass of the first liquid formulation to a mass of the second liquid formulation.

In some embodiments, the mixing chamber comprises a static mixer. In some embodiments, the static mixer has length ranging from about 0.5 mm to about 1 mm, a pitch ranging from about 0.5 to about 1.10, and a diameter ranging from about 0.1 mm to about 5 mm. In some embodiments, the static mixer is a 1.75 mixer. In some embodiments, the static mixer is two static mixers.

In some embodiments, the nozzle assembly comprises a plurality of nozzles having different nozzle outlet diameters. In some embodiments, a mixed formulation flow path fluidically connects the nozzle assembly with the mixing chamber, where the mixed formulation flow path comprises at least one upstream mixed formulation pool which splits into a plurality of downstream mixed formulation pools. In some embodiments, the pump draws the first liquid formulation and the second liquid formulation into the mixing chamber at a first flow rate and a second flow rate, respectively, where the first flow rate differs from the second flow rate.

In some embodiments, the first fluid conduit has a first diameter and the second fluid conduit has a second diameter, wherein the first diameter differs from the second diameter. In some embodiments, the first diameter is less than the second diameter. In some embodiments, the first formulation source and the second formulation source are disposed in a formulation cartridge reversibly couplable with the formulation dispensing assembly.

In another aspect, a method of preparing a mixed formulation, the method including drawing a liquid colorant and a liquid developer from a formulation cartridge into a formulation dispensing assembly, wherein the liquid colorant includes (a) a surfactant system comprising (i) at least one fatty amide, (ii) at least one alkoxylated fatty alcohol, (iii) at least one fatty alcohol other than the alkoxylated fatty alcohol, and, and (iv) at least one anionic surfactant, (b) at least one alkaline component, (c) at least one chelating agent, (d) optionally, at least one natural oil, and (e) a solvent system comprising (i) at least one glycol, (ii) at least one monoalcohol, and (iii) water, mixing the liquid colorant and the liquid developer in a mixing chamber of the formulation dispensing assembly, wherein the mixing chamber mixes the first formulation with the second formulation into a mixed formulation having a 1:1 mixture ratio of the first formulation to the second formulation with a 20% mixture ratio tolerance, and dispensing the mixed formulation from the formulation dispensing assembly, wherein the mixed formulation has a mixed formulation viscosity of at least 2.0 Pa-s at an outlet nozzle assembly of the formulation dispensing assembly is disclosed.

In some embodiments, drawing the liquid colorant and the liquid developer through the formulation dispensing assembly comprises pumping the liquid colorant and the liquid developer with a motorized pump. In some embodiments, the first liquid formulation has a dye load from 0.05% to 5.5%.

FIG. 1 illustrates one representative formulation delivery system 100 in accordance with the present disclosure. The formulation delivery system 100 includes a number of different features, including a formulation product line 102, a formulation delivery device 104, and an optional application 106, which together enable a customized user experience.

Formulation product line 102 includes different formulations 108, each being stored in a same (common) formulation cartridge 110 type that is configured for use with the formulation delivery device 104. Cartridges of the common formulation cartridge type are generally configured for insertion into a cartridge cavity of a reusable handle of the formulation delivery device. For example, in some embodiments, formulation cartridges and cleaning cartridges have a common cross-sectional shape and dimensions. Additionally, some embodiments of the common formulation cartridge type have a common number and arrangement of output nozzles.

Figure 2:
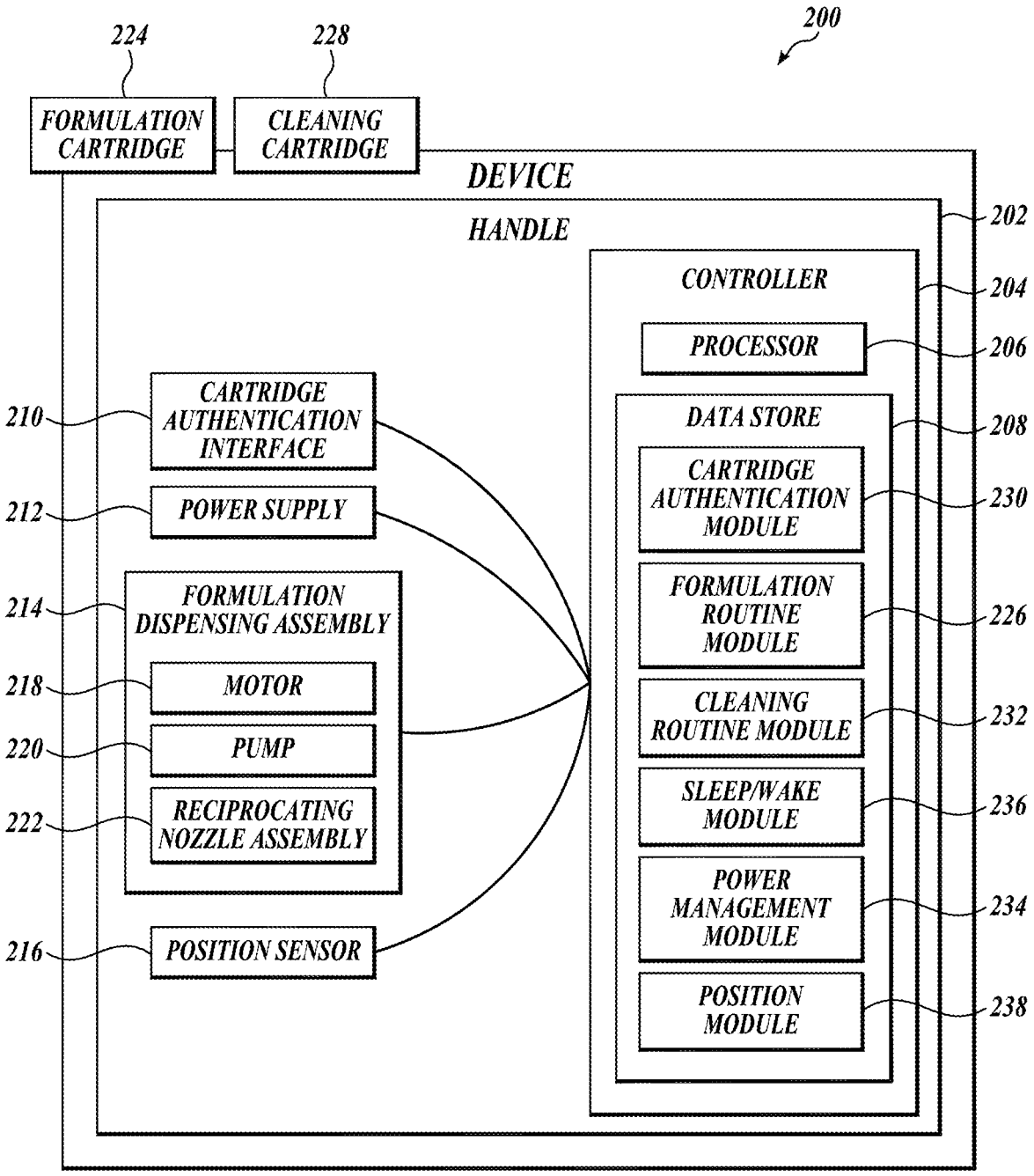
FIG. 2 shows a schematic overview of a formulation delivery device, in accordance with a representative embodiment of the present disclosure.

FIG. 2 shows a schematic overview of a representative formulation delivery device 200, to facilitate understanding of certain representative features thereof. The formulation delivery device 200 shall be understood to have the same features as the formulation delivery device 104 of FIG. 1

Formulation delivery device 200 includes a reusable handle 202 having a hollow elongate portion configured to reversibly receive the common formulation cartridge type (including the cleaning cartridge 112). Reusable handle 202 also houses a number of sub-assemblies, including a controller 204, which includes a processor 206 and data store 208 storing a number of modules (described below), cartridge authentication interface 210, power supply 212, formulation dispensing assembly 214, and an optional position sensor 216.

Power supply 212 is, in some embodiments, a direct current (DC) power supply, such as a rechargeable battery (e.g., a lithium ion battery) configured to be charged by plugging into a household alternating current outlet. In other embodiments, power supply 212 is an alternating current (AC) power supply, such as common household alternating current that utilizes an electrical cord (not shown) to supply power to the formulation delivery device 200.

Formulation dispensing assembly 214 provides formulation and/or cleaning liquid from the formulation cartridge 110 to a user's scalp or hair. In an embodiment, formulation dispensing assembly 214 includes: a first fluid conduit fluidically connected to a first formulation inlet (which couples with a first liquid output nozzle of the formulation cartridge 110), a second fluid conduit fluidically connected to a second formulation inlet (which couples with a second liquid output nozzle of the formulation cartridge 110), a motor 218, a pump 220 driven by the motor 218, and a reciprocating nozzle assembly 222 which is also driven by the motor 218.

Cartridge authentication interface 210 is an RFID reader, a nearfield reader, or the like, which is positioned in the reusable handle 202 such that when the formulation cartridge 110 is inserted therein, the cartridge authentication interface 210 reads an encryption chip disposed on the formulation cartridge 224, in order to authenticate the formulation cartridge in connection with the formulation routine module 226 described below.

Optional position sensor 216 includes one or more sensors that, alone or collectively, aid in the determination of the position and orientation of formulation delivery device 200 relative to a user's scalp or hair. In some embodiments, position sensor 216 includes one or accelerometers, touch sensors (e.g., capacitive touch sensors), proximity sensors (e.g., optical proximity sensors), or the like. Signals transmitted from the position sensor 216 are used by the controller 204, and certain modules thereof, in order to improve the accuracy and efficiency of formulation application to a user's hair or scalp.

Controller 204 is operatively connected (e.g., electrically connected) to the power supply 212, cartridge authentication interface 210, formulation dispensing assembly 214, and optional position sensor 216. Controller 204 includes the processor 206 (e.g., a general processing unit, graphical processing unit, or application specific integrated circuit), data store 926 (a tangible machine-readable storage medium), a plurality of modules implemented as software logic (e.g., executable software code), firmware logic, hardware logic, or various combinations thereof. In some embodiments, controller 204 includes a transceiver that transmits signals from any of the modules discussed below to the mobile device, and receives signals transmitted from the mobile device.

In some embodiments, controller 204 includes a communications interface having circuits configured to enable communication with the formulation delivery system, including formulation cartridge 224 (an encryption chip), cleaning cartridge 228, cartridge authentication interface 210, a mobile device and an application stored thereon, and/or other network element via the internet, cellular network, RF network, Personal Area Network (PAN), Local Area Network, Wide Area Network, or other network. Accordingly, the communications interface may be configured to communicate using wireless protocols (e.g., WIFI®, WIMAX®, BLUETOOTH®, ZIGBEE®, Cellular, Infrared, Nearfield, etc.) and/or wired protocols (Universal Serial Bus or other serial communications such as RS-216, RJ-45, etc., parallel communications bus, etc.). In some embodiments, the communications interface includes circuitry configured to initiate a discovery protocol that allows controller 204 and other network element (e.g., the formulation cartridge 110) to identify each other and exchange control information (e.g., identity of the formulation stored in the formulation cartridge 110). In an embodiment, the communications interface has circuitry configured to a discovery protocol and to negotiate one or more pre-shared keys.

Data store 208 is a tangible machine-readable storage medium that includes a mechanism that stores information in a non-transitory form accessible by a machine (e.g., processor 206, or mobile device 114). For example, a machine-readable storage medium includes recordable/non-recordable media (e.g., read only memory (ROM), random access memory (RAM), magnetic disk storage media, optical storage media, flash memory devices, etc.).

The modules described below are representative, not limiting. Accordingly, some embodiments of the controller 204 include additional modules, while other embodiments include fewer than all modules.

Cartridge authentication module 230 communicates with the cartridge authentication interface 210 in order to authenticate any formulation cartridge 224 or cleaning cartridge 228 which is inserted into the reusable handle 202. For example, upon insertion of the formulation cartridge 224 into the reusable handle 202, the cartridge authentication interface 210 reads an encrypted information from an encryption chip disposed on the formulation cartridge 224. If the cartridge authentication interface 210 successfully reads the encrypted information from the encryption chip, then the cartridge authentication module 230 "unlocks" the formulation delivery device 200, e.g., the formulation routine module 226. If, however, the cartridge authentication interface 210 cannot successfully authenticate the formulation cartridge inserted into the reusable handle 202, then it does not unlock the formulation delivery device 200. For example, if the formulation cartridge is a counterfeit cartridge or another cartridge containing inferior formulation, then the cartridge authentication module 230 does not unlock the functionality of the formulation delivery device 200. In this way, the cartridge authentication module 230 advantageously prevents the user from being harmed or having a poor experience.

Cartridge authentication module 230 is configured, in some embodiments, to read additional information from the encryption chip, including one or more of: a formulation identification, a beginning formulation quantity, a formulation expiration date, or a formulation production date. In such embodiments, cartridge authentication module 230 transmits the additional information to other modules for subsequent use.

Formulation routine module 226 stores a plurality of formulation routines for different formulations (e.g., haircare formulation routines), and causes the formulation dispensing assembly 214 to execute one or more formulation routines, based upon the formulation cartridge 224 authenticated by the cartridge authentication module 230. A formulation routine dispenses the authenticated formulation 108 from the formulation cartridge 224 through the reciprocating nozzle assembly 222. For example, a haircare formulation routine dispenses one or more haircare formulations from the reciprocating nozzle assembly 222, for a particular dispensation time, at a particular liquid flow rate of the pump, nozzle reciprocating frequency and/or reciprocating amplitude of the reciprocating nozzle assembly 222, and/or other device operating parameter specified by the formulation routine stored in the formulation routine module 226. In this way, the formulation delivery device 200 adjusts one or more device operating parameter based upon the specific formulation stored in the authenticated formulation cartridge 224 inserted into the formulation delivery device, for more effective hair and scalp treatment.

In some embodiments, formulation routine module 226 determines, based upon a dispensed time of the authenticated formulation, a dispensed volume of the authenticated formulation from the formulation cartridge through the formulation dispensing assembly. Based upon the dispensed time and/or dispensed volume, the formulation routine module 226 causes a visual indicator on the reusable handle 202 to signal a remaining formulation quantity. This helps the user anticipate when the formulation cartridge will need to be replaced and prompts the user to utilize the e-commerce module of the connected application to conveniently procure additional formulation cartridges.

Cleaning routine module 232 stores a cleaning routine and causes the formulation dispensing assembly 214 to execute the cleaning routine after the cleaning cartridge 228 (which has a reservoir filled with a cleaning liquid) is inserted into the reusable handle 202 and authenticated by the cartridge authentication module 230. The cleaning routine dispenses the cleaning liquid from the authenticated cleaning cartridge 228 through the reciprocating nozzle assembly 222 (e.g., for a predetermined time and at a predetermined flow rate), in order to evacuate any residual formulation within the formulation dispensing assembly 214. The cleaning routine is useful, for example, after one formulation has been utilized in the formulation delivery device 200, but before a second, different formulation is utilized. In some embodiments, the cleaning routine operates the pump 220 at a higher flow rate than one or more (or all) formulation routines stored by the formulation routine module 226, to clear all residual formulation.

In some embodiments, controller 204 is configured to toggle between at least a cleaning routine (provided by the cleaning routine module 232) and a formulation routine (provided by the formulation routine module 226) responsive to one or more inputs indicative of the cleaning cartridge or the formulation cartridge inserted into the reusable handle. Representative inputs include an authentication of the formulation cartridge or cleaning cartridge provided by the cartridge authentication module 230.

According to a method of the present disclosure, a method of cleaning any of the formulation delivery devices includes inserting the cleaning cartridge at least partially filled with the cleaning liquid into the reusable handle of the formulation delivery device and executing the cleaning routine until the cleaning liquid dispensed through the formulation dispensing assembly runs clear.

Power management module 234 provides power from the power supply 212 to one or more of the controller 204, cartridge authentication interface 210, formulation dispensing assembly 214, or the position sensor 216. Additionally, power management module 234 conserves available power resources (e.g., conserves battery life) by toggling the formulation delivery device 104 in between a sleep state (a passive state) and an awake state (an active state).

Sleep/awake module 236 manages whether the formulation delivery device 200 is in an awake state or a sleep state. The formulation delivery device 200 is in a sleep state by default, whereby little to no power is provided from the power supply 212 to the formulation dispensing assembly 214, cartridge authentication interface 210, and/or controller 204. In the sleep state, the formulation delivery device 200 is incapable of executing a formulation routine or cleaning routine. In the awake state, by comparison, the controller 204, cartridge authentication interface 210, formulation dispensing assembly 214, and position sensor 216 are sufficiently powered such that the formulation delivery device 104 is able to execute one or more formulation routines or cleaning routines. In some embodiments, the formulation delivery device 104 is "awakened," i.e., brought from the sleep state to the awake state, by: a push of a button disposed on the reusable handle 202, or by insertion of a formulation cartridge 224 or cleaning cartridge 228 into the reusable handle 202. In some embodiments, the formulation delivery device 200 returns to the sleep state after a predetermined inactivity period (e.g., 120 seconds of inactivity).

Position module 238 utilizes a position signal provided by the position sensor 216 to determine the position of the formulation delivery device 200, which position information is then provided to the formulation routine module 226 in order to facilitate execution of a formulation routine, e.g., a calibration routine. In some embodiments, the position module 238 provides the position signal to an application stored on a mobile device (via the transceiver), e.g., to enable execution of a calibration routine (described below) and/or to enable the application to display a correct application indication based upon the position signal.

Figure 3:
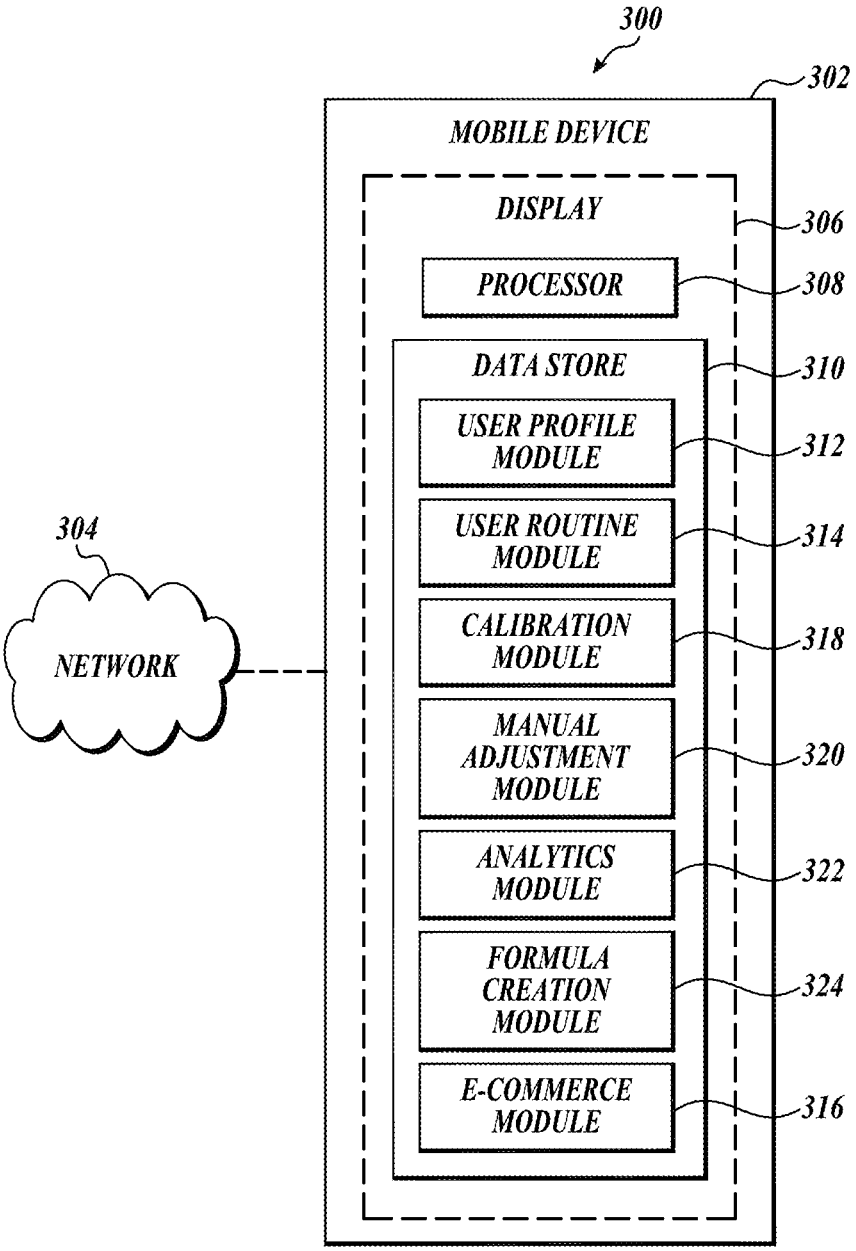
FIG. 3 shows a schematic overview of an application of a formulation delivery system, in accordance with a representative embodiment of the present disclosure.

FIG. 3 shows a schematic overview of a representative application 300, which shall be understood to have all feature of application 106 of FIG. 1 and is compatible with all formulation delivery systems and formulation delivery devices of the present disclosure. As noted above, the application 300 is configured to operate on a device, for example a mobile device such as a smartphone or a tablet. As one representative example, the application 300 is described in the context of a mobile device 302 connected to a network 304; however, this is not limiting.

Mobile device 302 has a display 306 (e.g., an LED or LCD display), a processor 308, and a data store 310 storing a plurality of modules. The terms "processor," "data store," and "module" have the same meaning as described above with respect to the controller 204, and as used below in connection with representative formulation delivery devices.

Each module described below presents one or more user interfaces on the display 306. The display 306 is a touch-sensitive display that is configured to receive user inputs thereon. Accordingly, for each module, the user interface presented on the display 306 is configured both to display information and to receive user inputs.

Application 300 includes a number of modules which personalize the user experience, including a user profile module 312 and user routine module 314. The modules described below are representative, not limiting. Accordingly, some embodiments of the application 300 include additional modules, while other embodiments include fewer than all modules.

User profile module 312 builds one or more profiles for users of the formulation delivery device 104. These profiles are provided as inputs to other modules, for example the user routine module 314 and the e-commerce module 316. Accordingly, the user profile module 312 provides one or more user interfaces that prompt a user to provide one or more user profile inputs, including: a hair color, a hair type (e.g., curly, straight), a colored/not colored state, an ethnicity, a hair condition (e.g., damaged), a scalp condition (e.g., itchy), and/or an age. The user profile module 312 accepts and stores the user profile inputs. In some embodiments, user profile module 312 communicates with user routine module 314 by providing one or more of the user profile inputs, or an entire user profile, to the user routine module 314. The user routine module 314 then utilizes one or more of the user profile inputs to create one or more user-specific routines for the user and/or to select one or more tutorials to present on the display 306.

In some embodiments, user profile module 312 communicates with formulation delivery device 104. For example, in some embodiments, the user profile module 312 adjusts at least one device operating parameter of a formulation routine (e.g., flow rate, dispense time, reciprocating amplitude, or reciprocating frequency) generated by the formulation routine module based upon one or more of the user profile inputs.

User routine module 314 helps the user effectively utilize the connected formulation delivery device by, in some embodiments, formulating one or more user-specific routines for each user based upon one or more user profile inputs. That is, the user routine module 314 builds a new formulation routine (rather than selecting a predetermined formulation routine) in order to effectively treat one or more conditions identified by the user profile inputs or to achieve one or more goals identified by the user profile inputs. As one representative example, where user inputs indicate that the user's hair is both colored and damaged, the user routine module 314 builds a user-specific routine that selects an appropriate hair repair formulation and shampoo formulation for the user's hair color from the formulation product line, and displays the user-specific routine (e.g., as instructions) for utilizing the selected hair repair formulation and shampoo at an interval in determined to improve the health of the user's hair.

In addition, user routine module 314 displays on the display 306: a) one or more passive tutorials for formulation routines, cleaning routines, and/or calibration routines; and/or one or more active instruction sets that instruct the user, as the user uses the formulation delivery device.

In some embodiments, the user routine module 314 receives one or more of the user profile inputs, or an entire user profile, from the user profile module 312, and then displays a passive tutorial (e.g., a pre-recorded instructional video) that is targeted at the user based upon the received user profile inputs or the user profile. As one example, the user routine module 314 receives a user profile input from the user profile module 312 indicating that the user has colored hair, and displays a tutorial on the display 306 showing the user how to use the formulation delivery device to color the user's hair.

In some embodiments, the user routine module 314 receives one or more position signals from the position sensor of the formulation delivery device via the controller. Based upon the received position signals, the user routine module 314 instructs the user how to use the formulation delivery device as the user uses the device (e.g., instructions to move the formulation delivery device in a particular direction, at a particular speed, in a particular pattern, to a particular spatial boundary). As one example, the user routine module 314 receives a position signal from the position sensor indicating that the formulation delivery device is positioned at a user's left temple; based upon this received position signal, the user routine module 314 displays a video instructing the user to apply a scalp treatment formulation by moving the formulation delivery device from the left temple to the right temple while dispensing the scalp treatment formulation.

In some embodiments, user routine module 314 receives a position signal from the formulation delivery device and displays a correct application indication based upon the position signal.

Calibration module 318 helps the user calibrate the formulation delivery device, which in turn increases the efficacy of formulation routines executed by the formulation delivery device. In some embodiments, the calibration module 318 displays a passive tutorial (e.g., a pre-recorded instructional video) that instructs the user how to complete a calibration routine. In some embodiments, the calibration module 318 provides one or more active instruction sets that instruct on how to use the complete a calibration routine as the user uses the formulation delivery device, and as the calibration module 318 receives position signals from the formulation delivery device.

According to one representative calibration routine, the calibration module 318 instructs the user to position the formulation delivery device at a plurality of calibration locations of a body portion of the user, e.g., in a particular order (e.g., a left temple, then a right temple, then a front hairline, and then a rear hairline). The user then moves the formulation delivery device to each of the calibration locations, indicating with a press of a button on the formulation delivery device or other action when the formulation delivery device is at the specified calibration location, and/or while the user moved the formulation delivery device from one calibration location to another.

Based upon position signals received from the position sensor of the formulation delivery device, the calibration module 318 and/or the formulation delivery device records the calibration locations. Then, the calibration module 318 and/or the formulation delivery device adjusts one or more user-specific routines based upon the recorded calibration locations. In some embodiments, this adjustment step includes adjusting a spatial limit and/or a temporal duration of one or more formulation routines stored in the formulation routine module).

Manual adjustment module 320 enables a user to manually adjust one or more device operating parameter of the formulation delivery device (e.g., flow rate, dispense time, reciprocating amplitude, or reciprocating frequency), for the advantage of greater control over the formulation delivery device and a more customized user experience. Accordingly, the manual adjustment module 320 presents a user interface with one or more user-adjustable and virtual sliding scales, switches, editable value fields, and the like, which are configured to receive one or more operating parameter inputs from the user. The manual adjustment module 320 receives the operating parameter inputs and transmits said operating parameter inputs to the formulation delivery device (e.g., the formulation routine module), which adjusts the corresponding device operating parameter based upon the corresponding operating parameter input (e.g., to match the operating parameter input).

Analytics module 322 receives device operating parameters (e.g., from formulation delivery device and computes helpful analytics, which the analytics module 322 then provides to the user via the user interface and/or to a third party via the network 304. Representative analytics include: a formulation usage pattern, a formulation purchase prediction, and diagnostics of the formulation delivery device. In some embodiments, analytics module 322 communicates with network 304 (e.g., an analytic platform disposed on one or more cloud-based servers) to retrieve additional information and/or to compute said analytics.

In some embodiments where the formulation delivery device comprises a position sensor that sends a position signal to the controller, and a transceiver that send the position signal to the mobile device. The formulation delivery device transmits the position signal to analytics module 322, which retrieves a user suggestion from an analytic platform on the network 116 based upon the received position signal and displays the user suggestion.

Formula creation module 324 enables a user to create a custom formulation based upon a user's selection of one or more formulation inputs, which correspond to one or more desired outcomes (e.g., desired hair color), one or more formulation inputs (e.g., an indication that the user's hair is damaged), and/or one or more of the user profile inputs provided to the user profile module 312. Accordingly, the formula creation module 324 is configured to receive one or more user profile inputs from the user profile module 312, and to formulate a custom formulation based upon those inputs.

To facilitate the user's creation of the custom formulation, formula creation module 324 provides a user interface with one or more user-adjustable and virtual sliding scales, switches, editable value fields, and the like corresponding to each formulation input. In some embodiments, formula creation module 324 communicates with network 304 (e.g., a database of formulations disposed on one or more cloud-based servers) to retrieve additional information and/or to formulate said custom formulation.

E-commerce module 316 presents a purchase interface that enables a user to purchase (including on a one-time or subscription basis) products related to the formulation delivery device. In some embodiments, e-commerce module 316 retrieves one or more custom formulations from formula creation module 324 (or components thereof) and presents on the purchase interface an option for the user to purchase one or more formulation cartridges 110 containing the custom formulation. In some embodiments, e-commerce module 316 retrieves one or more user profile inputs and/or user-specific routine inputs from user profile module 312 and presents on the purchase interface an option for the user to purchase one or more formulation cartridges containing the formulations which target the user profile inputs (for example, where the user inputs indicate damaged hair, a formulation cartridge containing a hair repair formulation). In some embodiments, e-commerce module 316 presents on the purchase interface an option to purchase the cleaning cartridge 112 or formulation delivery device 104 and/or components thereof. Such purchase interface and purchase options may be based upon a formulation usage pattern and/or a formulation purchase prediction retrieved from the analytics module 322.

Figure 4:
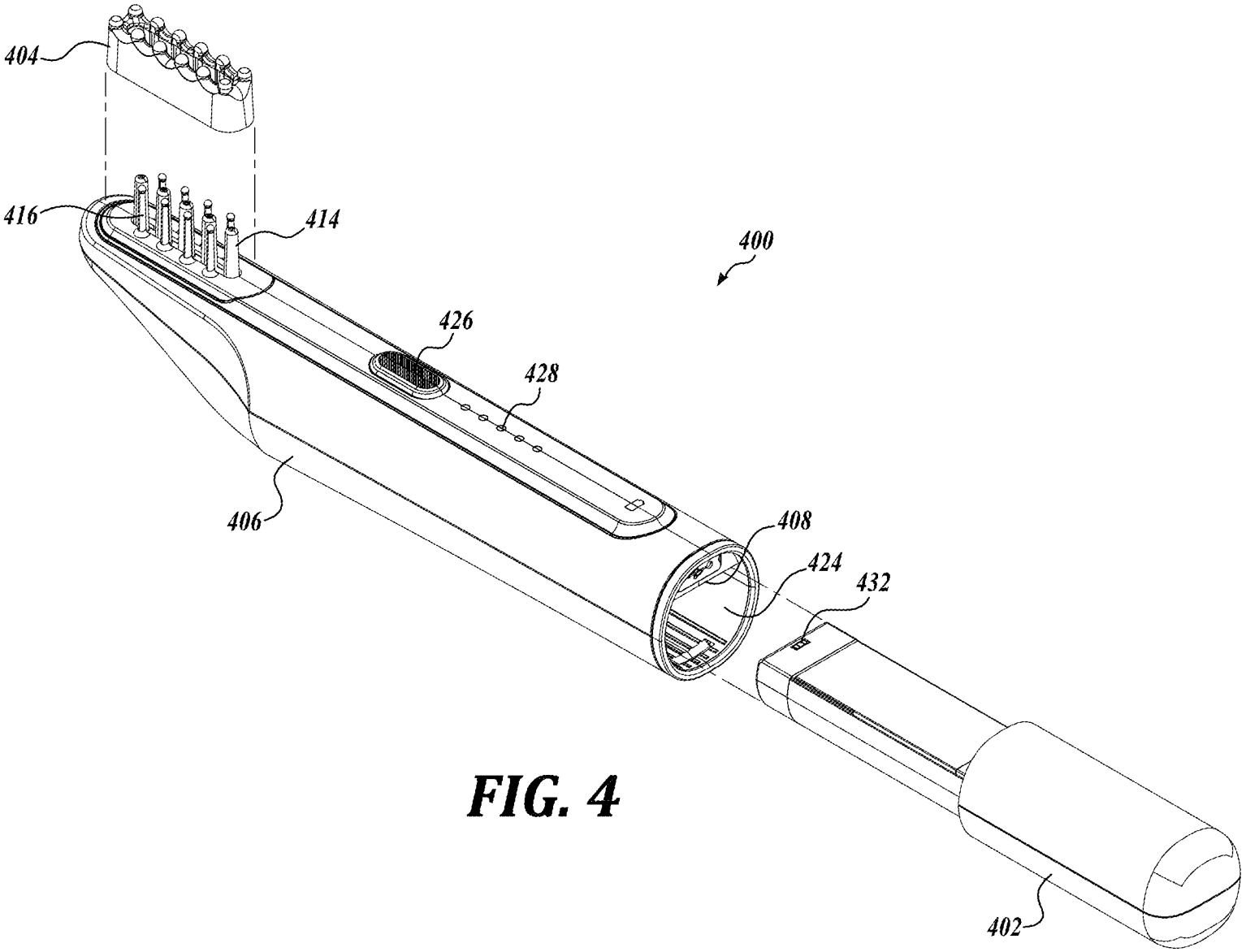
FIG. 4 shows an exploded perspective view of a formulation delivery device, in accordance with a representative embodiment of the present disclosure.
Figure 5:
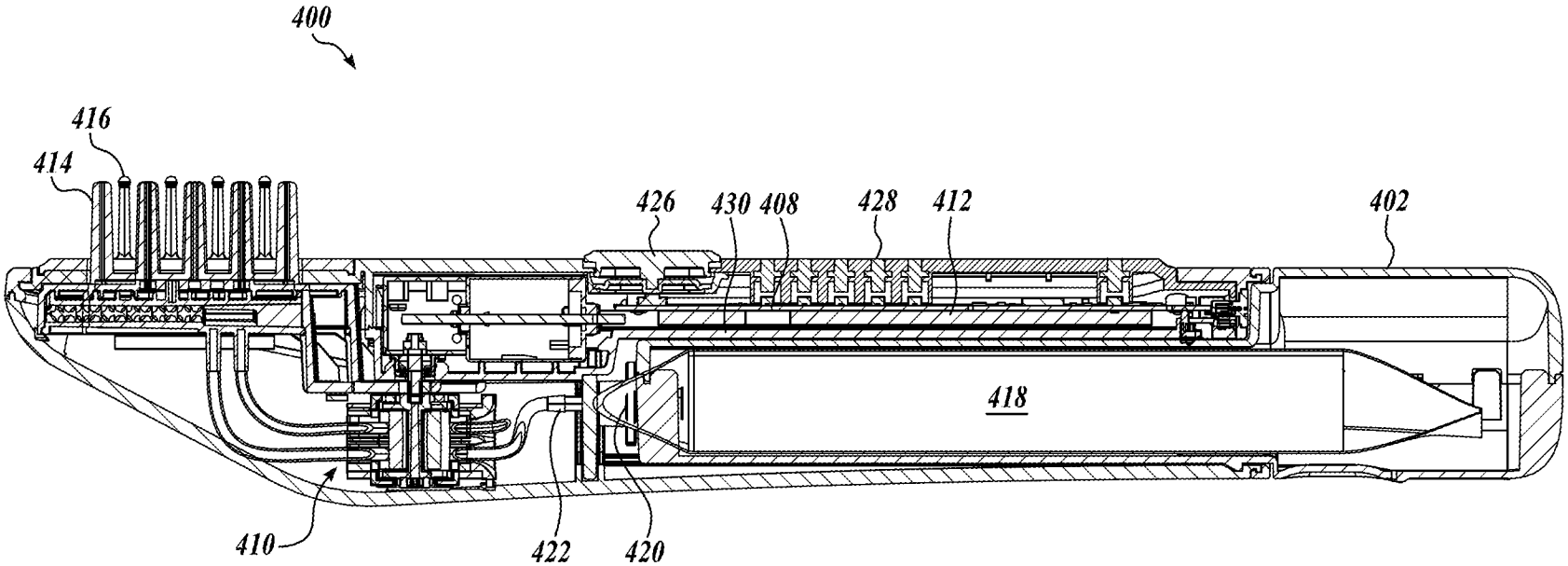
FIG. 5 shows a side section view of the formulation delivery device of FIG. 4.

FIG. 4-FIG. 5 show a representative formulation delivery device 400, and components thereof, in accordance with an embodiment of the present disclosure. The formulation delivery device 400 is configured to receive a formulation cartridge 402 type (including a cleaning cartridge of the same type). An embodiment of a formulation cartridge of the formulation cartridge 402 type is described below in detail with respect to FIG. 8A-FIG. 10; the formulation cartridge 402 shown in FIG. 4 shall be understood to have the same features as described there. Some embodiments of formulation delivery device 400 include the formulation cartridge 402 and/or an optional pull through adaptor 404.

Formulation delivery device 400 includes a reusable handle 406 formed from an ABS plastic or similar rigid polymer or other material, and in some embodiments is an assembly formed from a plurality of shells configured to be joined together with fastening elements such as snaps, screws, or the like. Reusable handle 406 has a hollow, elongate gripping portion with a cartridge cavity therein which is sized and dimensioned to receive the formulation cartridge 402 type. In some embodiments, the cavity includes keying features that facilitate correct insertion of the formulation cartridge 402 type. For example, some embodiments include a cartridge interface 408 disposed in the opening and having a flat docking surface that interfaces with a corresponding docking surface of the formulation cartridge 402 when the latter is correctly inserted into the opening.

Application 106 includes logic configured for operation on a non-transitory machine-readable storage medium, and includes modules that personalize the user experience, provide helpful analytics, and enable e-commerce. Application 106 runs on a mobile device 114 such as a smartphone, a tablet, or the like, and interacts with a user (e.g., an end user or a salon technician) to provide actionable information through a plurality of modules, which are described below with respect to FIG. 3. In some embodiments, the application 106 communicates with the formulation delivery device 104 and a network 116, such as a mobile network, a cloud-based enterprise network, a local area network, or the like.

Together, the formulation product line 102, formulation delivery device 104, and application 106 provide an improved, customized, user experience. Each of the foregoing elements of the formulation delivery system 100 will now be described in detail.

Formulation delivery device 104 is a connected electromechanical appliance that interacts with the user, with formulation cartridges 110, and optionally with the application 106 in order to provide a customized and personalized user experience. A representative formulation delivery device and sub-systems thereof are described below with respect to FIG. 4-FIG. 7.

Generally, formulation delivery device 104 comprises a reusable handle configured to receive the formulation cartridge 110 type, as well as a formulation dispensing assembly and a controller, both being disposed in the reusable handle. The formulation dispensing assembly comprises at least one fluid conduit fluidically connected to a motorized pump and to a reciprocating nozzle assembly, and is configured to draw formulation or cleaning liquid from the formulation cartridge 110 and to dispense the same through the reciprocating nozzle assembly onto a hair portion, scalp portion, or body portion of a user.

The controller is configured to toggle between at least a cleaning routine and formulation routine responsive to one or more inputs indicative of the cleaning cartridge or the formulation cartridge inserted into the reusable handle. The controller communicates with an encryption chip reader of a cartridge authentication interface in the reusable handle to read an encryption chip disposed on the formulation cartridge 110, in order to authenticate which formulation 108 is stored in the formulation cartridge 110 which is inserted into the reusable handle at any given time. In some embodiments, the controller also authenticates when the cleaning cartridge 112 is inserted into the reusable handle. Based upon the authenticated formulation 108 or cleaning cartridge 112, the controller causes the formulation delivery device 104 to execute a formulation routine that dispenses the authenticated formulation from the formulation cartridge through the formulation dispensing assembly. Based upon the authenticated cleaning cartridge 112, the controller also causes the formulation delivery device 104 to execute a cleaning routine that dispenses the cleaning liquid through the formulation dispensing assembly.

Reusable handle 406 houses a formulation dispensing assembly 410 (described below with respect to FIG. 5-FIG. 7), in addition to a controller 412. The formulation dispensing assembly 410 and controller 412 have the same features as the formulation dispensing assembly 214 and controller 204 of FIG. 2, respectively. An embodiment of a formulation dispensing assembly is described below in detail with respect to FIG. 6-FIG. 7; the formulation dispensing assembly 410 shown in FIG. 4 shall be understood to have the same features as described there.

Formulation dispensing assembly 410 dispenses formulation or cleaning liquid from the formulation cartridge 402, and includes a pump, fluid conduits, a mixing chamber, and a reciprocating nozzle assembly 414 (described below) with nozzles that extend away from the forward end of the reusable handle 406 in between a plurality of optional standoff portions 416. Reciprocating nozzle assembly 414 includes a plurality of annular nozzles that reciprocate back-and-forth along a track of the reusable handle 406 while dispensing formulation onto a user's skin or hair. In some embodiments, the reciprocating nozzle assembly 414 reciprocates at a reciprocating amplitude 7.0-12.0 mm (e.g., 8.0 mm-11.0 mm, or 9.0-10.0 mm) and/or at a reciprocating frequency of 5.0 Hz-10.0 Hz (e.g., 6.0 Hz-9.0 Hz, 6.0 Hz-8.0 Hz), which are adjustable by the formulation routine module, cleaning routine module, user routine module, manual adjustment module, or other module.

As shown in FIG. 5, formulation cartridge 402 has one or more formulation vessels 418 (e.g., pouches or packets) disposed therein, each of which has an output nozzle 420 protruding through a distal (forward) end of the formulation cartridge 402 in a configuration that fluidically connects with a corresponding formulation inlet 422 of the formulation dispensing assembly 410 when the formulation cartridge 402 is fully inserted into the cartridge cavity 424.

A button 426 disposed on the reusable handle 406 and electrically connected to the controller 412 activates features of the formulation delivery device 400 described above. In some embodiments, depressing the button 426 activates the features of any of the modules described above in FIG. 2. For example, in some embodiments, pressing button 426 activates a sleep/awake module stored in controller 412, thereby awakening formulation delivery device 400 from a sleep state to an awake state. In some embodiments, pressing button 426 while a formulation cartridge is inserted into the reusable handle 406 activates a formulation routine module stored in controller 412, thereby initiating a formulation routine.

In some embodiments, pressing button 426 while a cleaning cartridge is inserted into the reusable handle 406 activates a cleaning routine module stored in the controller 412, thereby initiating a cleaning routine. Visual indicators 428 (e.g., LEDs) disposed along the reusable handle 406 indicate one or more of a remaining formulation quantity or a remaining battery life, e.g., based upon a dispensed time determined by the formulation routine module of the controller. Some embodiments include additional buttons and/or a different number of visual indicators 428 with different functionalities, and the illustrated embodiment is not limiting. In some embodiments, visual indicator 428 is a multi-segment LED with each segment corresponding to an equal proportion of the formulation remaining in the formulation cartridge.

Controller 412 comprises logic (stored in a data store thereof), which when executed by a processor of the controller 412, causes a cartridge authentication interface 430 disposed in the reusable handle 406 (e.g., an RFID reader) to read an encryption chip 432 on the formulation cartridge 402 in order to authenticate the formulation cartridge 402. The encryption chip 432 stores at least one of the formulation cartridge 402, a formulation identification, a beginning formulation quantity, a formulation expiration date, or a formulation production date.

Controller 412 also comprises logic, which when executed, causes the formulation delivery device to execute, based upon authenticating the formulation cartridge 402, a formulation routine that dispenses a mixed formulation (of the first formulation and the second formulation) from the formulation cartridge 402 through the formulation dispensing assembly. For example, the formulation delivery device authenticates the first and second formulations after (or upon) insertion of a formulation cartridge into the reusable handle, and then, in response to pressing a button on the reusable handle, executes a formulation routine which causes formulation dispensing assembly 410 to continuously or continually mix the first and second formulations, and to dispense the same from the reciprocating nozzle assembly at one or more of the following predetermined device operating parameters for as long as the button is depressed: a formulation flow rate, a reciprocating frequency, or a reciprocating amplitude.

In some embodiments, controller 412 also comprises logic, which when executed, causes the formulation delivery device to execute, based upon authenticating a cleaning cartridge inserted into the reusable handles, a cleaning routine that dispenses a cleaning liquid through the formulation dispensing assembly. For example, the formulation delivery device authenticates a cleaning cartridge inserted into the reusable handle, and then, in response to pressing a button on the reusable handle, executes a cleaning routine which causes formulation dispensing assembly 410 to continuously or continually dispense a cleaning liquid (e.g., water) from the reciprocating nozzle assembly at one or more of the following predetermined device operating parameters for as long as the button is depressed: a cleaning liquid flow rate, a reciprocating frequency, or a reciprocating amplitude. In some embodiments, the cleaning liquid flow rate is higher than any formulation flow rate of one or more of the formulation routines stored in the controller 412, for the advantage of effectively flushing residual formulation from the formulation dispensing assembly.

Pull through adaptor 404 attaches to the reusable handle 406 over the reciprocating nozzle assembly 414. In some embodiments, pull through adaptor 404 provides an audible feedback signal upon correct engagement with the reusable handle 406. In some embodiments, the pull through adaptor 404 is a spacer, i.e., it is configured to space out the formula as it is dispensed. In this manner, the spacer controls how much formula is dispensed through the reciprocal nozzle assembly 414. In some embodiments, the spacer may be further configured to prevent clogging or excess product from dripping from the reciprocal nozzle assembly, by further directing the formula(s) or cleaning solution onto a user's skin or hair.

In some embodiments, the formula delivery system includes a first formulation source storing a first liquid formulation. In some embodiments, the first liquid formulation has a dye load from 0.05% to 5.5%. In some embodiments, the first liquid formulation is ammonia-free. In some embodiments, the first liquid formulation comprises ammonia and monoethanolamine. In some embodiments, the first liquid formulation comprises resorcinol. In some embodiments, the first liquid formulation is free of resorcinol and resorcinol derivatives.

In some embodiments, the formula delivery system includes a second formulation source storing a second liquid formulation. In some embodiments, the second liquid formula is a developer. In some embodiments, the second liquid formula comprises at least hydrogen peroxide. In some embodiments, the second liquid formula is a cream or a liquid.

In some embodiments, when the first liquid formula and the second liquid formula are mixed, the second liquid formula is activated. In some embodiments, the mixed formulation has a mixed formulation viscosity of at least 2.0 Pa-s. In some embodiments, the mixed formulation viscosity is from 2.0 Pa-s to 4.0 Pa-s.

Figure 6:
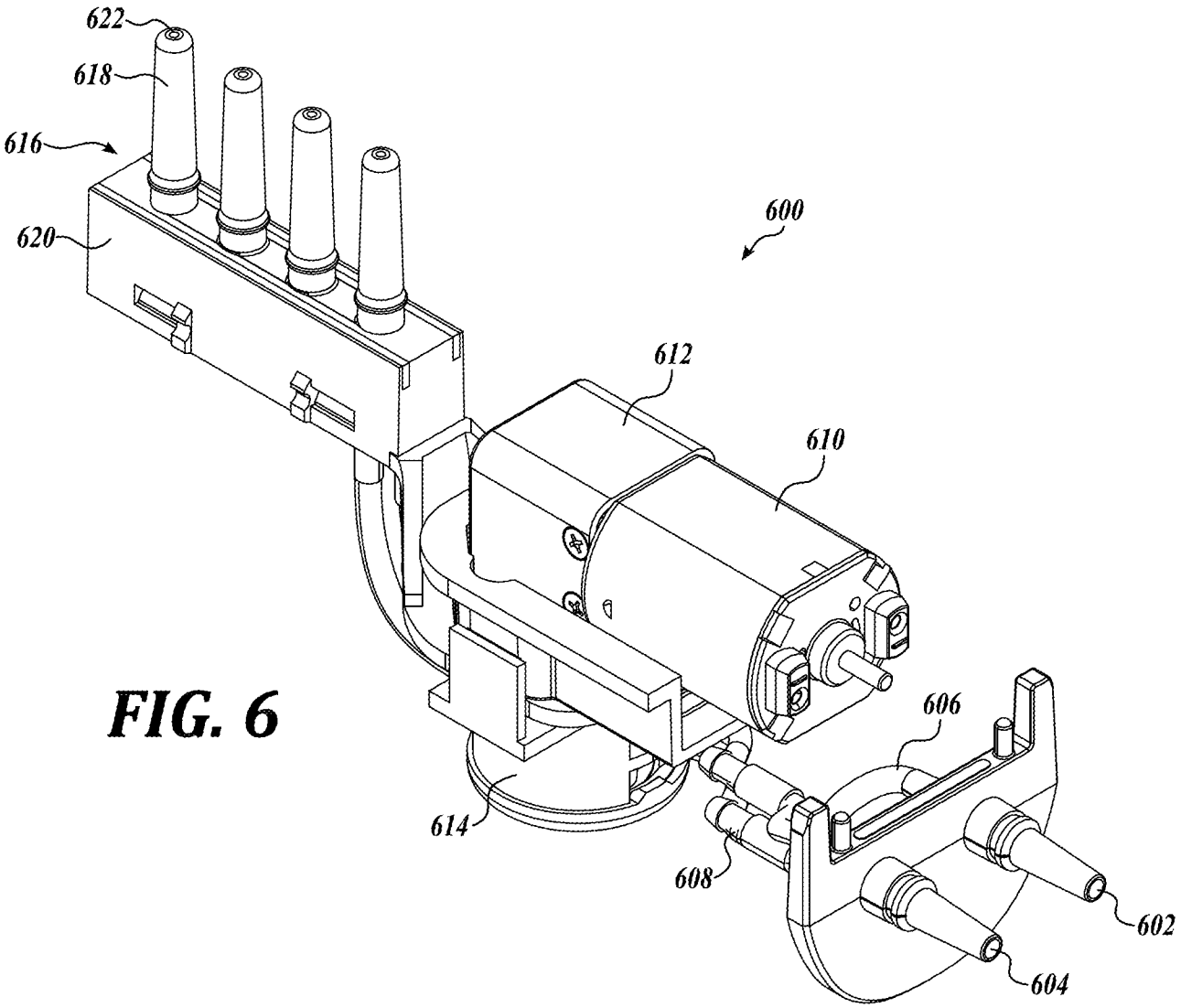
FIG. 6 shows a perspective view of a formulation dispensing assembly, in accordance with a representative embodiment of the present disclosure.
Figure 7:
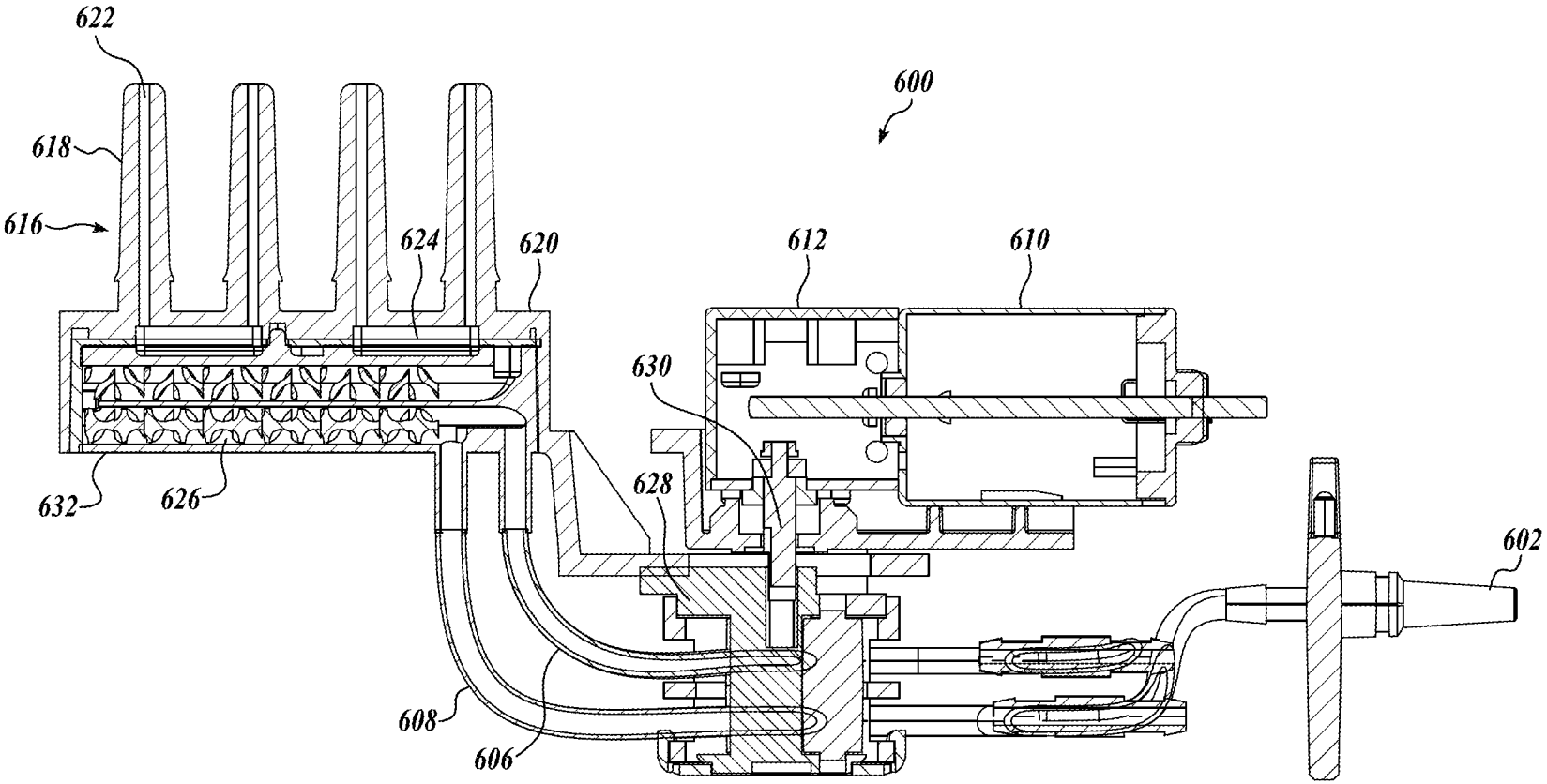
FIG. 7 shows a side section view of the formulation dispensing assembly of FIG. 6.

FIG. 6-FIG. 7 show a representative formulation dispensing assembly 600, which is compatible with any of the formulation delivery devices, formulation cartridges, and cleaning cartridges described herein. The primary function of the formulation dispensing assembly 600 is to dispense a mixed formulation of two different formulations from a formulation cartridge onto a user's skin or hair. In some embodiments, the formulation dispensing assembly 600 dispenses the mixed formulation at a flow rate of 20-40 mL/min or 120 mL per four minutes, e.g., 20-35 mL/min, 20-30 mL/min, 20-25 mL/min, 25-35 mL/min, 25-30 mL/min, or 35-40 mL/min.

Formulation dispensing assembly 600 includes a first formulation inlet 602 and a second formulation inlet 604, a first fluid conduit 606 and a second fluid conduit 608 fluidically connected to the first formulation inlet 602 and second formulation inlet 604, respectively. In some embodiments, each of the first formulation inlet 602 and second formulation inlet 604 are formed as protrusions extending rearwardly (i.e., toward the cartridge cavity when disposed in the reusable handle) from the first fluid conduit and the second fluid conduit, respectively, toward a rear end of the reusable handle, the protrusions being configured to project into the formulation cartridge.

The formulation dispensing assembly 600 also includes a motor 610, a gearbox 612 operatively connected to the motor 610, and a pump 614 driven by the motor 610 via the gearbox 612. In some embodiments, pump 614 is a peristaltic pump, which has been discovered to improve formulation dispensing when utilized in combination with the mixing chambers and tapered formulation channels described herein.

A reciprocating nozzle assembly 616 includes a plurality of annular nozzles 618 disposed on a comb 620, that, in use, cycles back-and-forth along a track of the reusable handle 406 while dispensing formulation onto a user's skin or hair, in order to achieve more uniform formulation coverage. Each of the nozzles 618 includes a formulation channel 622 therethrough, each of which is fluidically connected to the first fluid conduit 606 and second fluid conduit 608 via manifold 624. In some embodiments, each formulation channel 622 is tapered, for the advantage of increasing the formulation dispensing velocity and/or for further mixing the two formulations. The tapered formulation channel has proven advantageous when utilized in combination with other features described herein, e.g., wherein the pump 614 is a peristaltic pump and/or wherein the turbulent mixing chamber includes one or more helical mixers 626. In some embodiments, the nozzle assembly comprises a plurality of nozzles having different nozzle outlet diameters. In some embodiments, a mixed formulation flow path fluidically connects the nozzle assembly with the mixing chamber, wherein the mixed formulation flow path comprises at least one upstream mixed formulation pool which splits into a plurality of downstream mixed formulation pools. In some embodiments, the pump draws the first liquid formulation and the second liquid formulation into the mixing chamber at a first flow rate and a second flow rate, respectively, wherein the first flow rate differs from the second flow rate. In some embodiments, the first fluid conduit has a first diameter and the second fluid conduit has a second diameter, wherein the first diameter differs from the second diameter. In some embodiments, the first diameter is less than the second diameter. In some embodiments, the first formulation source and the second formulation source are disposed in a formulation cartridge reversibly couplable with the formulation dispensing assembly.

The motor 610 and gearbox 612 drive the reciprocating nozzle assembly 616 in linear reciprocating motion. In an embodiment, the linear reciprocating motion is motivated by an eccentric roller 628 coupled to an output shaft 630 of the gearbox 612, which eccentric roller 628 rotates inside an annular bracket of the comb 620. Driving the pump 614 and reciprocating nozzle assembly 616 with a common motor 610 improves power efficiency, reduces weight and size, thereby improving the form factor of the formulation delivery device. Nevertheless, some embodiments use more than one motor to drive the pump 614 and reciprocating nozzle assembly 616.

Nozzles 618 are fluidically connected to the first fluid conduit 606 and second fluid conduit 608 via a turbulent mixing chamber 632, which mixes a first formulation drawn from the formulation cartridge via the first fluid conduit 606 with a second formulation drawing from the formulation cartridge via the second fluid conduit 608 to create mixed formulation. In particular, the turbulent mixing chamber 632 mixes the two formulations by combining the same in a common chamber under pressure, and flowing the two formulations past one or more mixing elements, which create turbulent flow of the mixed formulation (as distinguished from laminar flow). The proportions of the first formulation to the second formulation vary in different embodiments. For example, is some embodiments, the mixed formulation is a mixture of a first formulation and a second formulation at a ratio of about 0.8:1.0-1.2:1.0, e.g., 0.85, 0.90, 0.95, 1.00, 1.05, 1.10, or 1.15.

In some embodiments, turbulent mixing chamber 632 is disposed between the pump 614 and the reciprocating nozzle assembly 616. In this configuration, the two formulations are mixed just before dispensing, which creates a more uniform formulation consistency and results in better formulation dispensation from the nozzles 618, as compared to mixing the formulations upstream of the pump 614.

In some embodiments, turbulent mixing chamber 632 includes a helical mixer 626 disposed therein. Some embodiments include a plurality of helical mixers 626 fluidically connected in series along a fluidic pathway within the turbulent mixing chamber 632, for improved mixing. In some embodiments, each helical mixer has an outside diameter between 2.00 mm and 5.00 mm, e.g., between 3.0 mm and 4.00 m, e.g., 3.18 mm. In some embodiments, each helical mixer has a total length of between 20.0 mm and 40.0 mm, e.g., between 25.0 mm and 35.0 mm, e.g., 33.0 mm. In some embodiments, each helical mixer has a length-to-diameter pitch (defined as total length/[outside diameter*#mixing elements]) between 0.75 and 1.25, e.g., between 0.80 and 0.90, e.g., 0.865. The combination of the foregoing specifications has been discovered to produce the best consistency of mixed formulation, particularly when the two formulations are not mixed until downstream of the pump 614, just upstream of the reciprocating nozzle assembly 616, and also when the pump 614 is a peristaltic pump.

In use, the pump 614 draws formulation from the connected formulation cartridge, through the first fluid conduit 606 and second fluid conduit 608, through the turbulent mixing chamber 632, through manifold 624, and through the nozzles 618. In the illustrated embodiment, the first fluid conduit 606 and second fluid conduit 608 are kept fluidically separate until downstream of pump 614, to prevent mixing of the two formulations until the turbulent mixing chamber 632. As stated previously, mixing the two formulations just before dispensation (i.e., between the pump 614 and manifold 624), improves the consistency of the mixed formulation.

FIG. 8A-FIG. 10 show a representative formulation cartridge 800 of a formulation cartridge type which is compatible with any of the formulation delivery systems, formulation delivery devices, and formulation product lines described herein. However, the formulation delivery systems, formulation delivery devices, and formulation product lines described herein are not required to use the sustainable formulation cartridge 800 shown in FIG. 8A-FIG. 10.

Formulation cartridge 800 is a sustainable embodiment specifically designed to reduce waste and environmental impact, while delivering a user-friendly experience. To that end, formulation cartridge 800 includes two main components: a handle portion 802 and a disposable formulation cartridge refill unit 804 (hereinafter referred to simply as refill unit 804) configured to reversibly slide into the handle portion 802. Historically, known cartridges were designed to be entirely disposed after depletion of the formulation stored therein, leading to significant waste and higher consumer cost.

In contrast to known cartridges, the formulation cartridge 800 is constructed such that the handle portion 802 can be reused indefinitely and the refill units 804 can be readily replaced after depletion of the formulation stored therein. Further still, each refill unit 804 is configured to be deconstructed into smaller components, some of which can be recycled in some embodiments, and others disposed of. Thus, the formulation cartridge 800 utilizes an innovative structure to reduce waste and improve the user experience.

Handle portion 802 is sized, dimensioned, and constructed to be repeatedly inserted into the cartridge cavity of the formulation delivery device. Accordingly, handle portion 802 is formed of ABS plastic or similar rigid polymer or other material and includes a hollow handle portion 802 configured to receive the refill unit 804 therein, and a tray portion 806 that extends away from handle portion 802. Handle portion 802 is a two-piece assembly in the representative embodiment shown (although it may be one-piece in other embodiments), and is sized and dimensioned such that it forms a seamless extension of the formulation delivery device handle when fully inserted into a cartridge cavity thereof. Tray portion 808 projects away from handle portion 802 and has a U-shape configured to support the refill unit 804 (e.g., the front body portion 810). To facilitate secure engagement and easy removal, handle portion 802 includes coupling means for coupling the formulation cartridge 800 to a reusable handle of a formulation delivery device. Representative coupling means include a cartridge release 812 (e.g., a latch) formed in the handle portion 802, which engages the formulation delivery device upon proper and complete insertion.

Thus, the common formulation cartridge 110 type enables a consumer to utilize many different formulations in a single formulation delivery device 104. A representative formulation cartridge 110 type is described below in FIG. 8A-FIG. 10, and a representative cleaning cartridge 112 is described in FIG. 12.

In a representative embodiment, the formulation product line 102 includes a hair coloring formulation and a scalp treatment formulation. In other representative embodiments, the formulation product line 102 comprises at least two, three, four, five, six, seven, or eight of the following different formulations, each of which is stored within the same formulation cartridge 110 type: a permanent hair dye and a developer; a semi-permanent hair dye and a developer; a shampoo; a conditioner; a hair growth treatment such as minoxidil; a hair protein treatment; a disulfide bond repairing hair treatment; or a fluid scalp treatment. In still further representative embodiments, the formulation product line 102 includes any of the above combinations, in addition to an optional cleaning cartridge 112 of the same formulation cartridge 110 type.

Formulation cartridge 110 type has an elongate shape and dimensions configured for insertion into a handle of the formulation delivery device 104, in particular into a cartridge cavity of the handle. In some embodiments of the formulation delivery system 100, the elongate outer housing has a different construction between formulation cartridges 110 containing formulation and the cleaning cartridge 112, but with common a common shape and dimensions. For example, in some embodiments, formulation cartridges 110 containing formulation have the construction of the partially recyclable embodiment shown in FIG. 8A-FIG. 10, while the cleaning cartridge 112 has similar shape and dimensions, but different materials and components.

Another feature of the formulation cartridge 110 type is a plurality of liquid output nozzles, which are sized and positioned at a distal (forward) end of the formulation cartridge 110 in a configuration that fluidically connects with a corresponding plurality of liquid inlets (e.g., first formulation inlets). In some embodiments, the liquid output nozzles are valves of formulation vessels (e.g., pouches or packets) disposed in the formulation cartridge 110.

A representative formulation cartridge 110 type, which is configured for insertion into formulation delivery device 104 and for storing a first formulation and a second formulation, is described below in FIG. 8A-FIG. 10.

Cleaning cartridge 112, which is of the common formulation cartridge 110 type (i.e., has common exterior dimension and a plurality of liquid output nozzles), enables a user to clean the formulation delivery device 104 by executing a cleaning routine that flushes a cleaning liquid (e.g., water) from the cleaning cartridge 112 through the fluid conduits of the formulation delivery device 104, thereby removing residual formulation in the formulation delivery device 104. Advantageously, the cleaning cartridge 112 and cleaning routine enable a significant portion of the formulation delivery device 104 to be reused for different formulations, thereby reducing waste and cost.

Cleaning cartridge 112 includes a refillable cleaning liquid reservoir disposed inside the outer housing, which is fluidically connected to the plurality of output nozzles. Thus, a user can fill the cleaning liquid reservoir with a cleaning liquid such as water, execute a number of cleaning routines on the formulation delivery device 104, and refill the cleaning liquid reservoir.

Figure 9A:
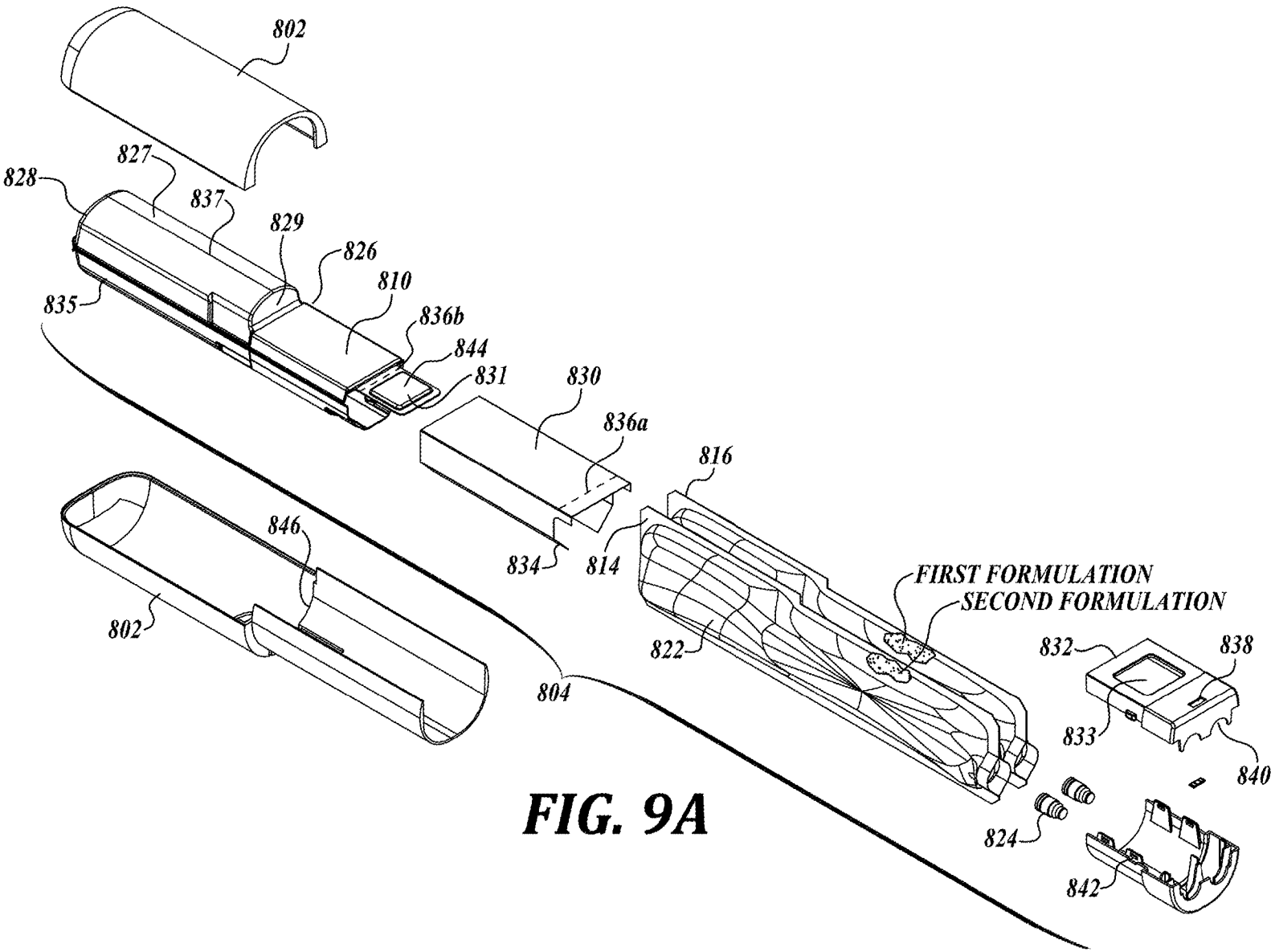
FIG. 9A shows an exploded perspective view of the formulation cartridge of FIG. 8A.
Figure 9B:
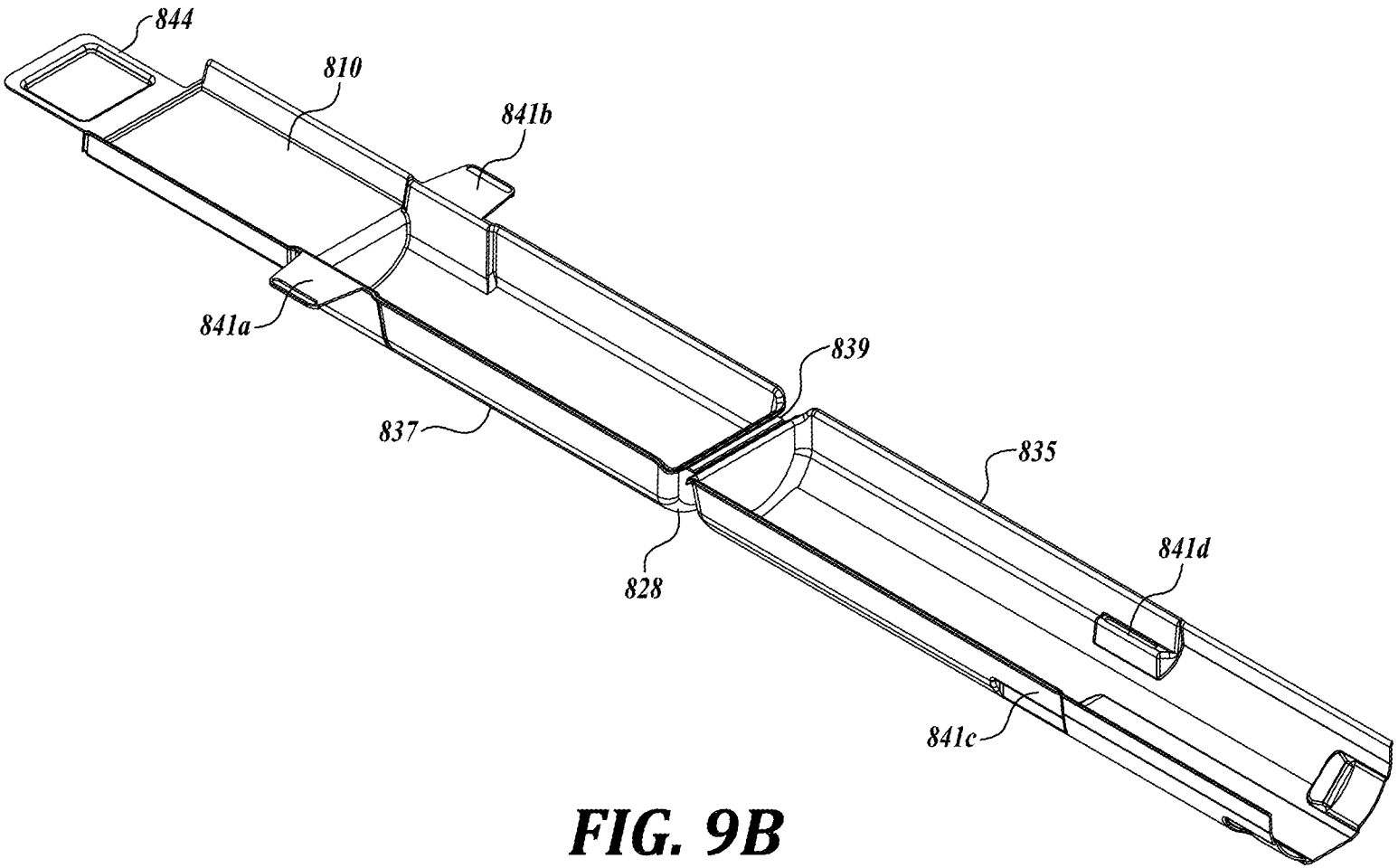
FIG. 9B shows a top view of a portion of the formulation cartridge of FIG. 8A.
Figure 10:
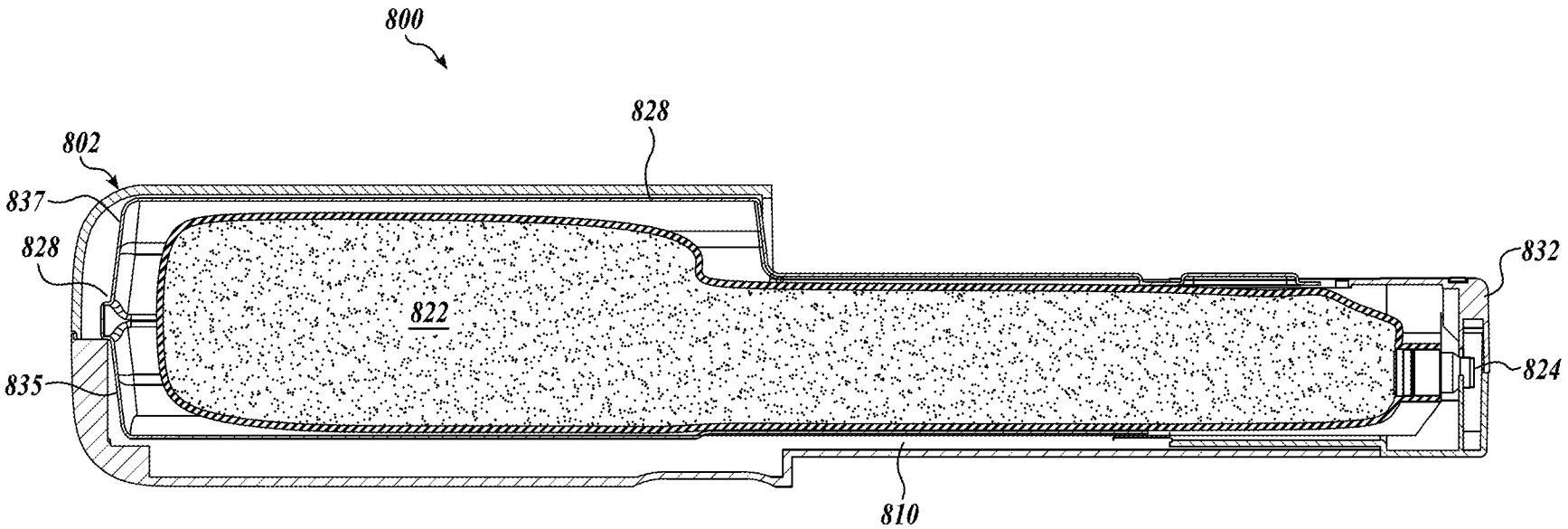
FIG. 10 shows a side section view of the formulation cartridge of FIG. 8A.

As best shown in FIG. 9A, refill unit 804 generally includes a refill packet comprising a shell 826 enclosing at least one formulation vessel (e.g., a packet, pouch, or other vessel), for example a first formulation pouch 814 and a second formulation pouch 816, and a valve frame 832 coupled with the refill packet, e.g., a front body portion 810 of the shell 826. The first formulation pouch 814 and second formulation pouch 816 respectively contain a first formulation 818 and a second formulation 820. The refill unit 804 may optionally include packet sleeve 830.

Each of first formulation pouch 814 and second formulation pouch 816 has a volume of about 40 mL to about 70 mL, about 50 mL to about 60 mL, about 40 mL to about 65 mL, about 40 mL to about 60 mL, about 40 mL to about 55 mL, about 40 mL to about 50 mL, about 45 mL to about 70 mL, about 50 mL to about 70 mL, about 55 mL to about 70 mL, about 60 mL to about 70 mL, or about 55 mL. In some embodiments, first formulation pouch 814 and second formulation pouch 816 have different volumes. In some embodiments, refill unit 804 stores only a single formulation vessel.

The first formulation 818 and second formulation 820 can each be any of the formulations described herein, for example a permanent hair dye; semi-permanent hair dye; developer; conditioner; hair growth treatment, such as minoxidil; hair protein treatment; disulfide bond repairing hair treatment; fluid hair treatment; fluid scalp treatment, or the like. In some embodiments, the first formulation 818 and second formulation 820 differ. For example, in some embodiments, the first formulation 818 is a hair dye and the second formulation 820 is a developer. In other embodiments, the first formulation 818 and second formulation 820 are the same (e.g., a conditioner or scalp treatment formulation).

As shown in FIG. 9A, each formulation pouch 814, 816 includes a formulation-containing packet 822 and valve means for selectively-fluidic coupling the refill unit to a dispensing nozzle unit of a formulation delivery device when the formulation cartridge 800 is received within the hand-held formulation dispensing device. Representative valve means include a valve 824 through which the formulation exits the packet 822. Representative formulation vessels are described in International Patent Application Publication No. 2019/067336A2, published Apr. 4, 2019 and assigned to L'Oreal S A, and U.S. Patent Application Publication No. 2021/0196021A1, published Jul. 1, 2021 and assigned to L'Oreal S A, both of which are hereby incorporated by reference in their entireties for all purposes.

The shell 826 has an elongate shape sized to be received within the reusable handle portion 802. Shell 826 encloses and protects the first formulation pouch 814 and second formulation pouch 816 and engages the valve frame 832 (described below). Thus, shell 826 functions as packaging which protects the formulation pouches 814, 816 during commerce prior to loading into the formulation delivery device.

In some embodiments, shell 826 has a total length between 150 mm and 250 mm (e.g., 175 mm-225 mm, 185 mm-215 mm, 195 mm-205 mm, or 200 mm) and a maximum cross sectional dimension of 25 mm-50 mm (e.g., 30 mm-45 mm, 35 mm-40 mm, or 36 mm). Shell 826 has a rear body portion 828 and a slender front body portion 810, e.g., a neck portion, extending away from the body portion 828. The body portion 828 and the slender front body portion 810 generally align in a common longitudinal direction to enable assembly with the reusable handle portion 802, and to enable insertion into the cartridge cavity of the formulation delivery device.

In some embodiments, shell 826 is constructed at least partially from a recyclable or recycled material, e.g., a paper material such as an injection-molded paper material or a die-cut structured paper (e.g., cardboard). In the illustrated embodiment, the shell 826 is formed from a single piece of injection-molded paper material. In some embodiments in which the shell 826 is formed of paper, the paper has a weight between 8-12 points (e.g., 8.5 points, 9.0 points, 9.5 points, 10.0 points, 10.5 points, 11.0 points, or 11.5 points), to impart sufficient stiffness without contributing excess disposable material.

The rear body portion 828 of the shell 826 has a larger cross-sectional dimension than the front body portion 810 when viewed in a plane normal to the longitudinal direction of the cartridge 800. A hump or bulge 827 imparts the larger cross sectional area of the rear body portion 828 relative to the slender front body portion 810. Advantageously, the hump or bulge 827 enables the use of higher-volume formulation pouches 814, 816. Additionally, the hump or bulge 827 forms an abutment 829 which abuts a corresponding interior face of the handle portion 802 and secures the longitudinal position of the shell 826 during use.

The slender front body portion 810 of the shell 826 is sized to fit within the tray portion 806 of the handle portion 802 and to project into the cartridge cavity of the formulation delivery device during use. As shown best in FIG. 8A, the front body portion 810 couples with the valve frame 832. To facilitate secure connection and alignment with the valve frame 832, front body portion 810 includes valve frame coupling means, for example at least one coupling tab 844 configured to selectively engage the valve frame 832. In the illustrated embodiment, the front body portion 810 includes a single coupling tab 844 extending away from a front end thereof. The coupling tab 844 includes an engagement feature, for example a detent or raised prominence 831 shaped and sized to engage a complementary aperture 833 of the valve frame 832.

Shell 806 may have many different configurations. For example, referring to FIG. 9A and FIG. 9B together, the illustrated shell 806 is a clamshell configuration formed with at least two partial shells (in this embodiment, two halves 835, 837) hingedly coupled by a hinge 839, for example a living hinge integrally formed with the two halves. In the embodiment shown, the hinge 839 is disposed at distal end of the shell 806, i.e., at a distal end of each of half 835, 837. In other embodiments, the hinge may be disposed at a different location, e.g., along a longitudinal edge of the halves. In some embodiments, the shell 806 includes a different number of partial shells, e.g., three or four partial shells which come together to enclose the formulation pouches 814, 816. In still other embodiments, shell 806 comprises a single piece forming an open-ended tube into which the formulation pouches 814, 816 may be inserted.

Alignment of the halves 835, 837 enables correct attachment of the front body portion 810 to the valve frame 832. To this end, as shown best in FIG. 13 (deleted), the halves 835, 837 include optional complementary alignment means 841*a-d*, for example tabs and complementary slots. The alignment means shown are representative, not limiting. In other embodiments, the alignment means may include different fasteners, e.g., hook-and-loop fasteners. In still other embodiments, the partial shells may be configured to align with each other by friction fit or by other means. In addition to aligning the halves, alignment means 841*a-d* help hold the halves together.

While the illustrated shell 826 is formed of an injection molded paper material, this construction is representative, not limiting. In some embodiments, shell 826 is formed of a single piece of die-cut paper stock, which is folded to impart a three dimensional structure having the rear body portion 828 and slender neck portion 810 extending away therefrom. In some such embodiments, this folded construction creates a polygonal cross section in the rear body portion 828 and a polygonal cross section in the front body portion 810 (for example, octagonal and hexagonal cross sections, respectively). To facilitate assembly, some such embodiments of the shell 826 include one or more scores or guidelines that ensure correct folding. Some embodiments have a triangular, rectangular, pentagonal, hexagonal, heptagonal, octagonal, or other polygonal cross-sectional shape.

Optional packet sleeve 830 slides over the neck portion 810 and provides several important advantages. First, it imparts additional structure to the refill unit 804 by sliding over and reinforcing front body portion 810. Accordingly, in some embodiments, packet sleeve 830 has a greater weight or thickness as compared to the material that forms shell 826; although this is not required. In some embodiments, packet sleeve 830 is also formed of a recyclable material, which may be the same material as the shell 826.

Second, in some embodiments, packet sleeve 830 couples with the valve frame 832. For example, the illustrated packet sleeve 830 includes a plurality of engagement member recesses 834 configured to reversibly couple with engagement members of the valve frame 832.

Figure 8A:
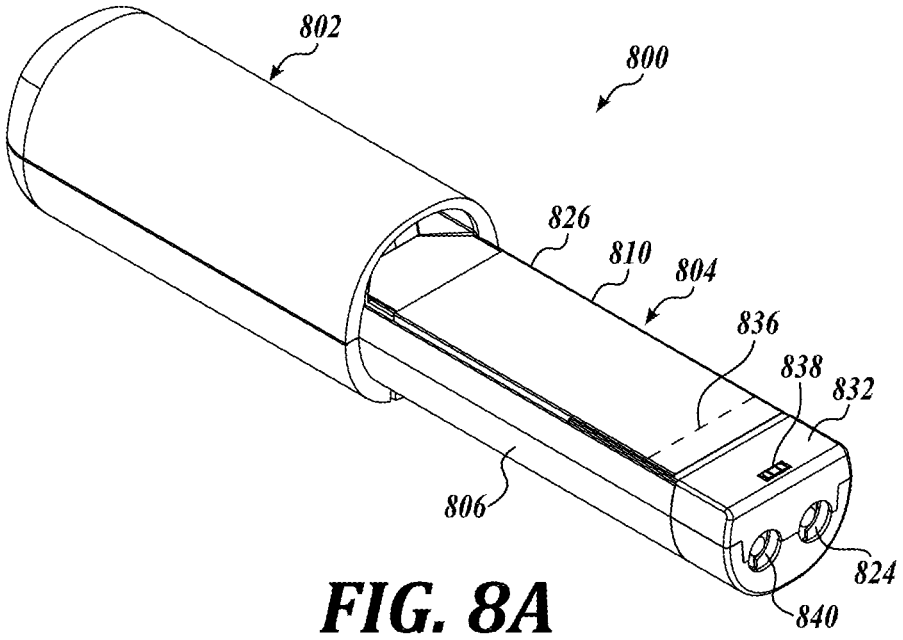
FIG. 8A shows a first perspective view of a formulation cartridge, in accordance with a representative embodiment of the present disclosure.
Figure 8B:
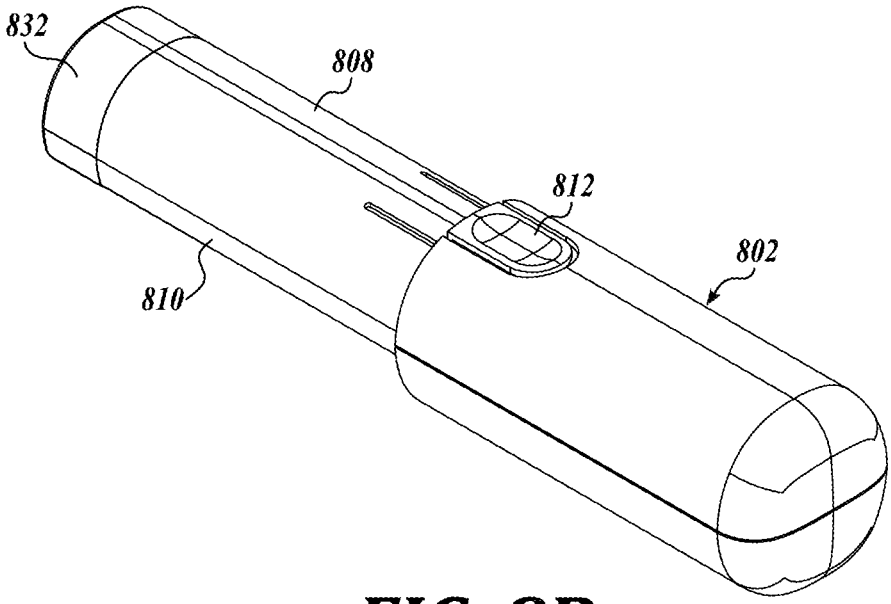
FIG. 8B shows a second perspective view of the formulation cartridge of FIG. 8A.

Third, packet sleeve 830 facilitates disassembly of the refill unit 804. As shown in FIGS. 8A and 9, in some embodiments, packet sleeve 830 includes an optional integral tearaway 836*a* formed thereon (e.g., a perforation with a pull tab). In other embodiments, the tearaway is formed on the neck portion 810 (see tearaway 836*b*). In use, after the formulation packets 814, 816 are depleted, a user pulls the pull tab of integral tearaway 836*a* and/or 836*b*, thereby separating valve frame 832 from packet sleeve 830. Upon completion of this action, the packet sleeve 830 is recycled and the valve frame 832 is discarded. In some embodiments, the integral tearaway 836 is disposed on the shell 826, e.g., the front body portion 810.

Valve frame 832 provides a rigid structure which aligns the formulation pouch valves 824 for correct fluid interconnection with the fluid conduits of the formulation delivery device. Additionally, in some embodiments, valve frame 832 supports an optional encryption chip 838 as described above. In such embodiments, valve frame 832 is sized and shaped to accurately position the encryption chip 838 adjacent to the cartridge authentication interface of the formulation delivery device when the formulation cartridge 800 is disposed in the handle of the formulation delivery device. Accordingly, valve frame 832 is formed from ABS plastic, HDPE, or other rigid polymer or other material. In some embodiments, valve frame 832 is formed from a same material as shell 806.

A plurality of valve engagement units 840 extend through a front end of the valve frame 832. Each valve engagement unit 840 receives and secures one of the formulation pouch valves 824. In some embodiments, the valve engagement unit 840 is a valve aperture or cutout disposed through a face of the valve frame 832, the valve aperture or cutout being sized to receive a valve of a formulation pouch and optionally to engage an outer circumference of the valve. To enable coupling with the packet sleeve 830 (or shell 826 in some embodiments), valve frame 832 includes optional engagement members 842 (e.g., tabs) extending therefrom. In some embodiments, valve frame 832 engages with the front body portion 810 by a friction fit.

Encryption chip 838 (e.g., an RFID tag) is disposed on the refill unit 804, e.g., on the body portion 826 or on the valve frame 832 (as in the illustrated embodiment). The encryption chip 838 is positioned on the refill unit 804 such that when the formulation cartridge 800 is inserted into the formulation delivery device, it is positioned to be read by the cartridge authentication interface thereof. Accordingly, the encryption chip 838 stores information about the formulation cartridge 800 and its contents, for example at least one of a formulation identification, a beginning formulation quantity, a formulation expiration date, or a formulation production date.

Thus, the shell 826, formulation pouches 814, 816, valve frame 832, and optional packet sleeve 830 form the refill unit 804. In use, refill unit 804 is reversibly couplable with handle portion 802, e.g., by securing means such as coupling tabs on the shell 826 or by friction fit between the refill unit 804 and the handle portion 802.

Figure 11:
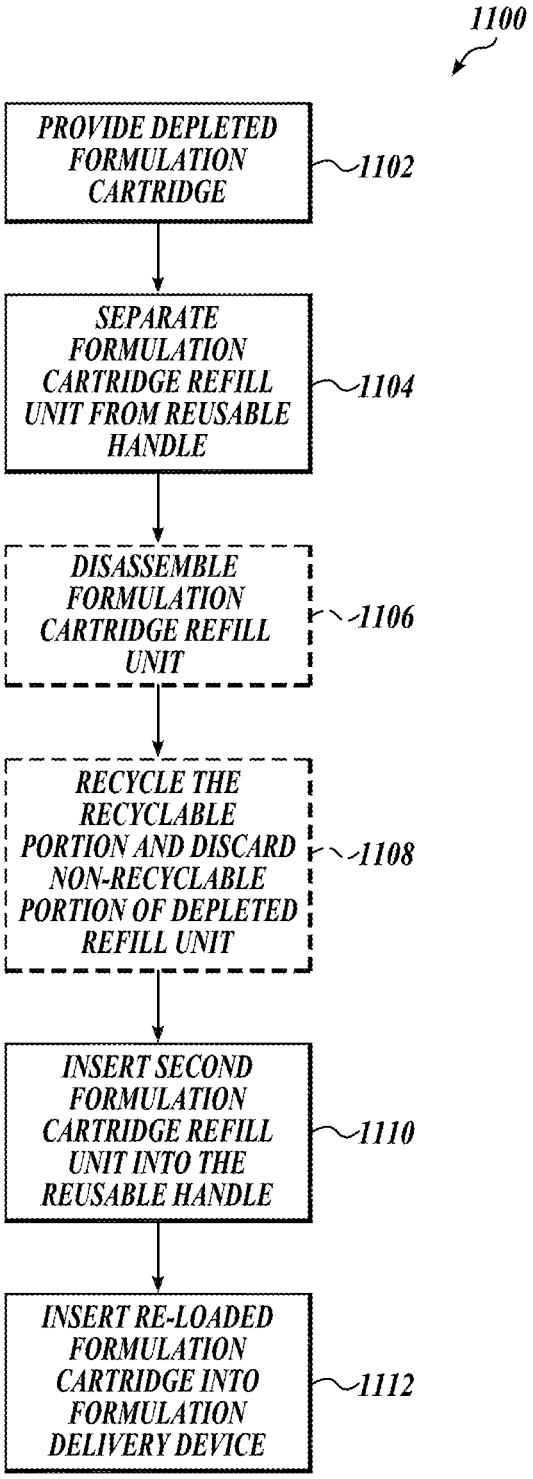
FIG. 11 shows a method of reloading a formulation cartridge, in accordance with a representative embodiment of the present disclosure.

FIG. 11 shows representative methods 1100 which may be used with any of the formulation cartridges of the present disclosure, for example the formulation cartridge 800 of FIG. 8A-FIG. 10. As one example, FIG. 11 provides methods of replenishing or reloading formulation cartridges of the present disclosure.

At step 1102, a formulation cartridge is provided, e.g., a formulation cartridge configured to provide at least one formulation to a formulation delivery device. In some embodiments, the formulation cartridge includes a formulation pouch which is depleted of formulation. In some embodiments, the formulation cartridge is removed from a formulation delivery device, e.g., by depressing a cartridge release and pulling the formulation cartridge out of the formulation delivery device. In any embodiment, the formulation cartridge comprises a reusable body or handle and a formulation cartridge refill unit, which may include a valve frame engaging a refill packet storing the at least one formulation. In any embodiment, the refill packet includes a shell enclosing at least one vessel storing the at least one formulation.

At step 1104, the formulation cartridge refill unit is separated from the reusable handle. In some embodiments, the reusable handle is disassembled into two or more parts, thereby revealing at least a portion of the formulation cartridge refill unit, and then removing the formulation cartridge refill unit from the disassembled reusable handle.

In optional step 1106, the formulation cartridge refill unit is at least partially disassembled, for example by separating the refill packet from the valve frame (such as by separating at least one formulation vessel from a shell). In some embodiments, a recyclable portion of the refill unit is separated from a non-recyclable portion of the refill unit. For example, the valve frame and formulation pouches are separated from the body portion and/or the optional packet sleeve (both of which are recyclable in some embodiments), e.g., by tearing an integral tearaway on the packet sleeve or body portion and pulling the valve frame (along with the depleted formulation pouches secured thereto) away from the packet sleeve and body portion.

In optional step 1108, the recyclable portion(s) of the refill unit is recycled (i.e., the body portion, the valve frame, and/or the packet sleeve), and the non-recyclable portion(s) is discarded (i.e., the depleted formulation pouches and valve frame).

In step 1110, a new refill unit is inserted into the reusable cartridge handle.

In step 1112, the reloaded formulation cartridge is inserted again into the formulation delivery device after inserting the new refill unit into the reusable cartridge handle.

Thus, the present disclosure provides not only sustainable formulation cartridges, but also methods of using the same to further reduce waste and environmental impact.

Figure 12:
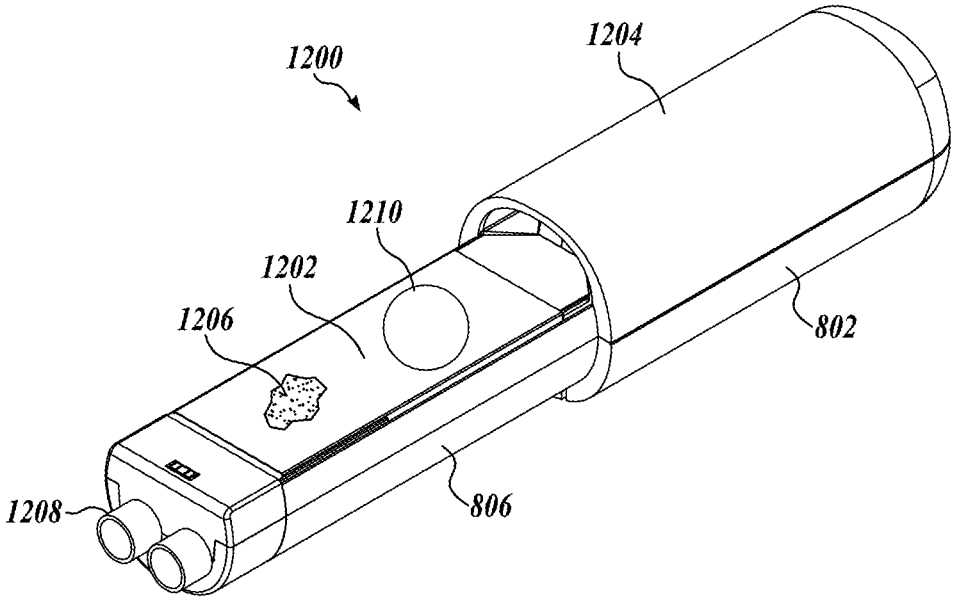
FIG. 12 shows a perspective view of a cleaning cartridge, in accordance with a representative embodiment of the present disclosure.

FIG. 12 shows a representative cleaning cartridge 1200, which has the same features as cleaning cartridges described previously, and which is compatible with any formulation delivery system, formulation delivery device, and product line of the present disclosure. Accordingly, cleaning cartridge 1200 is of a same cartridge type (e.g., is configured to securely fit inside the reusable handle of the formulation delivery device, has the same shape and dimensions and a plurality of output nozzles) as formulation cartridges described herein.

The primary function of cleaning cartridge 1200 is to fluidically connect with a formulation delivery device, and to provide a cleaning liquid 1202 (e.g., water) that is flushed through a formulation dispensing assembly as part of a cleaning routine. Accordingly, cleaning cartridge 1200 is a reusable assembly with a body portion 1204 formed of an ABS plastic or other suitably rigid polymer. Body portion 1204 supports a cleaning liquid reservoir 1206, i.e., a tank, which stores the cleaning liquid 1202 therein, e.g., 50-200 mL thereof. The cleaning liquid reservoir 1206 has a plurality of output nozzles 1208 which are sized and positioned to fluidically couple with fluid conduits of the formulation delivery device. A refill cap 1210 facilitates refilling the cleaning liquid reservoir 1206.

FIGS. 13A-13C are graphs of the viscosity of an example shade and developer in several ratios, in accordance with a representative embodiment of the present disclosure. On the horizontal axis is the shear rate, S, in 1/s. On the vertical axis is the viscosity G in Pas. As denoted with the key in the top right corner of the graph, plotted are the viscosities of the 25-volume developer by itself, the colorant by itself, the shade mixed with the developer in a 1:1 ratio, the shade mixed with the developer in a 2:1 ratio, and the shade mixed with the developer in a 3:1 ratio. FIG. 13A shows the viscosity of Shade 1.1 (having a high dye load) and 25V developer in the described ratios. When Shade 1.1 is mixed with the developer in a mixture of 2:1 and 3:1, the viscosity of the formulation is lower than that of the developer alone. However, in the 1:1 ratio of colorant to developer, the viscosity was higher than that of the developer on its own. FIG. 13B shows the viscosity of Shade 5 (having a medium dye load) and 25V developer in the described ratios. Like the 1.1 Shade, mixing Shade 5 with developer in a 1:1 ratio resulted in a high viscosity formula, higher than the viscosity of the developer on its own. The 2:1 mixture also resulted in a similar viscosity, but the 3:1 mixture resulted in a viscosity lower than that of the developer on its own. FIG. 13C shows the viscosity of Shade 10 and 25V developer in the described ratios. The viscosity of Shade 10 (having a low dye load) and developer in a 1:1 ratio was higher than that of the developer alone and decreases steadily as the shear rate increases. While the viscosity of the 2:1 and 3:1 mixtures are higher than that of the developer alone, the viscosity sharply decreases as the shear rate increases. As shown, in each case, when the developer and colorant are mixed in a ratio of 1:1, the viscosity increased higher than that of the colorant or developer alone. Further, as the sheer rate increases, the viscosity of all the formulas declined.

FIGS. 14A-14B are graphs of the viscosity of an example shade and developer mixed by hand and with a device, in accordance with a representative embodiment of the present disclosure. On the horizontal axis is the shear rate in 1/s. On the vertical axis is the viscosity in Pas. The red (change) dots represent a conventional mixer "the EVT1B device" with the disclosed technology "the Colorsonic". The formulation had a much higher viscosity when mixed by the disclosed technology than when mixed by the conventional device. The black circle represents the starting viscosity of the formulations. As the shear rate increased, the viscosity of both formulations decreased, but the conventional technology formulation did so sharply, while the disclosed technology formulation decreased smoothly and consistently. FIG. 14A shows the viscosity of Shade 1.1, while FIG. 14B shows the viscosity of Shade 10.

FIGS. 15A-15C are graphs of beginning viscosity of example formulations made with a variety of mixing methods, in accordance with a representative embodiment of the present disclosure. On the horizontal axis is the type of mixing, selected from a hand mix device (as described herein), a 2-mixer device, EVT1B (a conventional device), and Raven (another conventional device). On the vertical axis is the viscosity in Pas. As is shown in FIGS. 15A-15C, the hand mix and the 2-mixer devices resulted in higher beginning viscosities than the two conventional devices. This was seen in Shade 1.1 (FIG. 15A), Shade 5 (FIG. 15B), and Shade 10 (FIG. 15C).

The present application may reference quantities and numbers. Unless specifically stated, such quantities and numbers are not to be considered restrictive, but representative of the possible quantities or numbers associated with the present application. Also, in this regard, the present application may use the term "plurality" to reference a quantity or number. In this regard, the term "plurality" is meant to be any number that is more than one, for example, two, three, four, five, etc. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

Embodiments disclosed herein may utilize circuitry in order to implement technologies and methodologies described herein, operatively connect two or more components, generate information, determine operation conditions, control an appliance, device, or method, and/or the like. Circuitry of any type can be used. In an embodiment, circuitry includes, among other things, one or more computing devices such as a processor (e.g., a microprocessor), a central processing unit (CPU), a digital signal processor (DSP), an application-specific integrated circuit (ASIC), a field-programmable gate array (FPGA), or the like, or any combinations thereof, and can include discrete digital or analog circuit elements or electronics, or combinations thereof.

In an embodiment, circuitry includes one or more ASICs having a plurality of predefined logic components. In an embodiment, circuitry includes one or more FPGA having a plurality of programmable logic components. In an embodiment, circuitry includes hardware circuit implementations (e.g., implementations in analog circuitry, implementations in digital circuitry, and the like, and combinations thereof). In an embodiment, circuitry includes combinations of circuits and computer program products having software or firmware instructions stored on one or more computer readable memories that work together to cause a device to perform one or more methodologies or technologies described herein. In an embodiment, circuitry includes circuits, such as, for example, microprocessors or portions of microprocessor, that require software, firmware, and the like for operation. In an embodiment, circuitry includes an implementation comprising one or more processors or portions thereof and accompanying software, firmware, hardware, and the like. In an embodiment, circuitry includes a baseband integrated circuit or applications processor integrated circuit or a similar integrated circuit in a server, a cellular network device, other network device, or other computing device. In an embodiment, circuitry includes one or more remotely located components. In an embodiment, remotely located components are operatively connected via wireless communication. In an embodiment, remotely located components are operatively connected via one or more receivers, transmitters, transceivers, or the like.

An embodiment includes one or more data stores that, for example, store instructions or data. Non-limiting examples of one or more data stores include volatile memory (e.g., Random Access memory (RAM), Dynamic Random Access memory (DRAM), or the like), non-volatile memory (e.g., Read-Only memory (ROM), Electrically Erasable Programmable Read-Only memory (EEPROM), Compact Disc Read-Only memory (CD-ROM), or the like), persistent memory, or the like. Further non-limiting examples of one or more data stores include Erasable Programmable Read-Only memory (EPROM), flash memory, or the like. The one or more data stores can be connected to, for example, one or more computing devices by one or more instructions, data, or power buses.

In an embodiment, circuitry includes one or more computer-readable media drives, interface sockets, Universal Serial Bus (USB) ports, memory card slots, or the like, and one or more input/output components such as, for example, a graphical user interface, a display, a keyboard, a keypad, a trackball, a joystick, a touch-screen, a mouse, a switch, a dial, or the like, and any other peripheral device. In an embodiment, circuitry includes one or more user input/output components that are operatively connected to at least one computing device to control (electrical, electromechanical, software-implemented, firmware-implemented, or other control, or combinations thereof) one or more aspects of the embodiment.

In an embodiment, circuitry includes a computer-readable media drive or memory slot configured to accept signal-bearing medium (e.g., computer-readable memory media, computer-readable recording media, or the like). In an embodiment, a program for causing a system to execute any of the disclosed methods can be stored on, for example, a computer-readable recording medium (CRMM), a signal-bearing medium, or the like. Non-limiting examples of signal-bearing media include a recordable type medium such as any form of flash memory, magnetic tape, floppy disk, a hard disk drive, a Compact Disc (CD), a Digital Video Disk (DVD), Blu-Ray Disc, a digital tape, a computer memory, or the like, as well as transmission type medium such as a digital and/or an analog communication medium (e.g., a fiber optic cable, a waveguide, a wired communications link, a wireless communication link (e.g., transmitter, receiver, transceiver, transmission logic, reception logic, etc.). Further non-limiting examples of signal-bearing media include, but are not limited to, DVD-ROM, DVD-RAM, DVD+RW, DVD-RW, DVD-R, DVD+R, CD-ROM, Super Audio CD, CD-R, CD+R, CD+RW, CD-RW, Video Compact Discs, Super Video Discs, flash memory, magnetic tape, magneto-optic disk, MINIDISC, non-volatile memory card, EEPROM, optical disk, optical storage, RAM, ROM, system memory, web server, or the like.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

While illustrative embodiments have been illustrated and described, it will be appreciated that various changes can be made therein without departing from the spirit and scope of the invention.

The embodiments of the invention in which an exclusive property or privilege is claimed are defined as follows:

1. A formulation delivery system, comprising:

a first formulation source storing a first liquid formulation, wherein the first liquid formulation comprises:
a surfactant system,
at least one alkaline component,
at least one chelating agent, and
a solvent system, a second formulation source storing a second liquid formulation, wherein the second liquid formulation comprises hydrogen peroxide;

a formulation dispensing assembly configured to fluidically couple with the first formulation source and the second formulation source, the formulation dispensing assembly comprising:

a first fluid conduit and a second fluid conduit respectively connected with the first formulation source and the second formulation source;

a pump fluidically connected to the first fluid conduit and second fluid conduit;

a mixing chamber connected with the first fluid conduit and the second fluid conduit, wherein the mixing chamber mixes the first formulation with the second formulation into a mixed formulation having a 1:1 mixture ratio of the first formulation and the second formulation with a 20% mixture ratio tolerance; and a nozzle assembly in fluid connection with the mixing chamber.

2. The formulation delivery system of claim 1, wherein the first liquid formulation has a dye load from 0.05% to 5.5%.

3. The formulation delivery system of claim 1, wherein the mixed formulation has a mixed formulation viscosity of at least 2.0 Pa-s.

4. The formulation delivery system of claim 3, wherein the mixed formulation viscosity is from 2.0 Pa-s to 4.0 Pa-s.

5. The formulation delivery system of claim 1, wherein the first liquid formulation is ammonia-free.

6. The formulation delivery system of claim 1, wherein the first liquid formulation comprises ammonia and monoethanolamine.

7. The formulation delivery system of claim 6, wherein the first liquid formulation comprises resorcinol.

8. The formulation delivery system of claim 5, wherein the first liquid formulation is free of resorcinol and resorcinol derivatives.

9. The formulation delivery system of claim 1, wherein the mixture ratio is defined as a mass of the first liquid formulation to a mass of the second liquid formulation.

10. The formulation delivery system of claim 1, wherein the mixing chamber comprises a static mixer.

11. The formulation delivery system of claim 10, wherein the static mixer has a length ranging from about 0.5 mm to about 1 mm, a pitch ranging from about 0.5 to about 1.10, and a diameter ranging from about 0.1 mm to about 5 mm.

12. The formulation delivery system of claim 1, wherein the nozzle assembly comprises a plurality of nozzles having different nozzle outlet diameters.

13. The formulation delivery system of claim 1, wherein a mixed formulation flow path fluidically connects the nozzle assembly with the mixing chamber, wherein the mixed formulation flow path comprises at least one upstream mixed formulation pool which splits into a plurality of downstream mixed formulation pools.

14. The formulation delivery system of claim 1, wherein the pump draws the first liquid formulation and the second liquid formulation into the mixing chamber at a first flow rate and a second flow rate, respectively, wherein the first flow rate differs from the second flow rate.

15. The formulation delivery system of claim 1, wherein the first fluid conduit has a first diameter and the second fluid conduit has a second diameter, wherein the first diameter differs from the second diameter.

16. The formulation delivery system of claim 15, wherein the first diameter is less than the second diameter.

17. The formulation delivery system of claim 1, wherein the first formulation source and the second formulation source are disposed in a formulation cartridge reversibly couplable with the formulation dispensing assembly.

18. A method of preparing a mixed formulation, the method comprising:

drawing a liquid colorant and a liquid developer from a formulation cartridge into a formulation dispensing assembly, wherein the liquid colorant comprises:
a surfactant system,
at least one alkaline component,
at least one chelating agent, and
a solvent system, mixing the liquid colorant and the liquid developer in a mixing chamber of the formulation dispensing assembly, wherein the mixing chamber mixes the first formulation with the second formulation into a mixed formulation having a 1:1 mixture ratio of the first formulation to the second formulation with a 20% mixture ratio tolerance; and dispensing the mixed formulation from the formulation dispensing assembly, wherein the mixed formulation has a mixed formulation viscosity of at least 2.0 Pa-s at an outlet nozzle assembly of the formulation dispensing assembly.

19. The method of claim 18, wherein drawing the liquid colorant and the liquid developer through the formulation dispensing assembly comprises pumping the liquid colorant and the liquid developer with a motorized pump.

20. The method of claim 18, wherein the first liquid formulation has a dye load from 0.05% to 5.5%.

* * * * *